US005825344A

United States Patent [19]

Hughes et al.

[11] Patent Number: 5,825,344

[45] Date of Patent: Oct. 20, 1998

[54] TEMPERATURE COMPENSATION OF FERRO-ELECTRIC LIQUID CRYSTAL DISPLAYS

[75] Inventors: Jonathan R. Hughes; David Charles Scattergood; Michael John Towler, all of Malvern, Great Britain

[73] Assignee: The Secretary of State for Defence in Her Britannic Majesty's Government of the United Kingdom of Great Britain and Northern Ireland, Hants, United Kingdom

[21] Appl. No.: 704,785

[22] PCT Filed: Feb. 28, 1995

[86] PCT No.: PCT/GB95/00417

§ 371 Date: Sep. 26, 1996

§ 102(e) Date: Sep. 26, 1996

[87] PCT Pub. No.: WO95/24715

PCT Pub. Date: Sep. 14, 1995

[30] Foreign Application Priority Data

Mar. 7, 1994 [GB] United Kingdom ..... 9404356.9

[51] Int. Cl.[6] ..... G09G 3/36

[52] U.S. Cl. ..... 345/101; 345/94

[58] Field of Search ..... 345/97, 87, 88, 345/89, 94, 95, 96, 98, 99, 100, 101, 103, 208, 209, 210, 214; 349/72

[56] References Cited

U.S. PATENT DOCUMENTS 4,923,285 5/1990 Ogino et al. .

FOREIGN PATENT DOCUMENTS

0197743A2 4/1986 European Pat. Off. .

0285402A2 3/1988 European Pat. Off. .

0303343A1 6/1988 European Pat. Off. .

WO92/02925 2/1992 WIPO .

OTHER PUBLICATIONS

Patent Abstracts of Japan vol. 12, No. 76 (P–675) 10 Mar. 1988 & JP,A,62215241 (Seiko Instr. & Electronics Ltd.) 21 Sep. 1987.

*Primary Examiner*—Xiao Wu

*Attorney, Agent, or Firm*—Nixon & Vanderhye P.C.

[57] ABSTRACT

The invention provides an addressing scheme with temperature compensation for temperature induced changes in liquid crystal material switching parameters. Temperature compensation is provided by measuring liquid crystal temperature, and varying the length of strobe waveforms accordingly. A ferroelectric liquid crystal cell is addressed by row and column electrodes forming an x,y matrix of display elements. A strobe waveform is applied to each row in sequence whilst appropriate data waveforms are applied to all the column electrodes. At each display element, the material receives an addressing waveform to switch it to one of its two switched states depending upon the polarity of the addressing waveform. The data waveforms are, e.g., alternating positive and negative pulses of period 2 ts. The strobe waveform has a zero for one time period ts followed by a unipolar voltage pulse of significant duration, e.g., equal to or greater than 0.25 ts or more. This may result in an overlapping of addressing in adjacent rows, e.g., the end of a strobe pulse on one row overlaps with the beginning of a strobe pulse on the next row. The display elements may be switched into one of their two states by one of two strobe pulses of opposite polarity. Alternatively, a blanking pulse may switch all elements to one state and a strobe used to switch selected elements to the other state.

15 Claims, 18 Drawing Sheets

TEMPERATURE COMPENSATION OF FERRO-ELECTRIC LIQUID CRYSTAL DISPLAYS

BACKGROUND OF THE INVENTION

Temperature compensation of ferro-electric liquid crystal displays.

This invention relates to the temperature compensation of multiplex addressed ferro-electric liquid crystal displays. Such displays use a tilted chiral smectic C, I, or F liquid crystal material.

DISCUSSION OF PRIOR ART

Liquid crystal devices commonly comprise a thin layer of a liquid crystal material contained between two glass slides. Optically transparent electrodes are formed on the inner surface of both slides. When an electric voltage is applied to these electrodes the resulting electric field changes the molecular alignment of the liquid crystal molecules. The changes in molecular alignment are readily observable and form the basis for many types of liquid crystal display devices.

In one type of ferro electric liquid crystal device, surface stabilised ferro electric liquid crystal devices (SSFLC—N. A. Clark & S. T. Lagerwall, App Phys Lett 36(11) 1980 pp 899–901), the molecules switch between two different alignment directions depending on the polarity of an applied electric field. These devices have a bistability and remain in one of the two switched states until switched to the other switched state. This allows the multiplex addressing of quite large displays.

One common multiplex display has display elements, ie pixels, arranged in an x, y matrix format for the display of e.g., alpha numeric characters. The matrix format is provided by forming the electrodes on one slide as a series of column electrodes, and the electrodes on the other slide as a series of row electrodes. The intersections between each column and row form addressable elements or pixels. Other matrix layout are known, e.g, polar co-ordinate (r–g), and seven bar numeric displays.

There are many different multiplex addressing schemes. A common feature is application of a waveform, called a strobe waveform to each row or line in sequence. Coincidentially with the strobe applied at each row, appropriate one of two waveforms, called data waveforms are applied to all column electrodes for one period of the data waveform, frequently called the line address time. The differences between the different schemes lies in the shape of the strobe and data voltage waveforms.

European Patent Application 0,306,203 describes one multiplex addressing scheme for ferro electric liquid crystal displays. In this application the strobe is a unipolar pulse of alternating polarity, and the two data waveforms are rectangular waves of opposite sign. The strobe pulse width is one half the data waveform period. The combination of the strobe and the appropriate one of the data voltages provides a switching of the liquid crystal material.

GB 2,262,831, WO-A-92/02925, describes another addressing scheme in which a strobe waveform is first a zero for one time slot followed by a dc pulse of length greater than one time slot, eg two time slots or more. Data waveforms are alternating pulses of +/– data voltages Vd of pulse length one time slot. Line address time is twice the time slot length. The effect of this is that there is an overlapping of addressing time between different rows. Extending the time length of the strobe pulse means an overlapping of addressing in successive row electrodes. Such overlapping effectively increases the width of the switching pulse whilst not affecting the other waveforms and thus reduces the total time taken to address a complete display whilst maintaining a good contrast ratio between elements in the two different switched states.

Other addressing schemes are described in GB 2,146,473-A; GB-2,173,336A; GB-2,173,337-A; GB-2,173,629-A; WO 89/05025; Harada et al 1985 S. I. D Digest Paper 8.4 pp 131–134; and Lagerwall et al 1985 IEEE, IDRC pp 213–221; Proc 1988 IEEE, IDRC p 98–101 Fast Addressing for Ferro Electric LC Display Panels, P Maltese et al.

The liquid crystal material may be switched between its two states by two strobe pulses of opposite sign, in conjunction with a data waveform. Alternatively, a blanking pulse may be used to switch the material into one state, and a single strobe pulse used with an appropriate data pulse to selectively switch back pixels to the other state. Periodically the sign of the blanking and the strobe pulses are alternated to maintain a net zero d.c. value.

These blanking pulses are normally greater in amplitude and length of application than the strobe pulses so that the material switches irrespective of which of the two data waveforms is applied to any one intersection. Blanking pulses may be applied on a line by line basis ahead of the strobe, or the whole display may be blanked at one time, or a group of lines may be simultaneously blanked.

One known blanking scheme uses blanking pulse of equal voltage (V) time (t) product Vt, but opposite polarity, to the strobe pulse Vt product. The blanking pulse has an amplitude of half and a time of application of twice that of the strobe pulse. These values ensure the blanking and strobe have a net zero d.c. value without periodic reversal of polarity.

Another known scheme with a blanking pulse is described in EP 0,378.293. This uses a conventional d.c. balanced strobe pulse (of equal periods of opposite polarity) with a similar d.c. balanced blanking pulse (of equal periods of opposite polarity) in which the width of the blanking pulse may be several times that of the strobe pulse. Such a scheme has a net zero d.c. value without periodic reversal of polarity of blanking and strobe waveforms.

The feature of d.c. balance is particularly important in projection displays since if it is desired to switch the gap between pixels to one optical state then periodic reversal of polarities is not permissible.

One problem with existing displays is the variation of device parameters with temperature; this limits the temperature range over which a device may be used. To overcome this problem it is common to change the drive parameters. Typically this will involve the row or (strobe) voltage Vs, the column (data) voltage Vd, and the line address time. This is described in EP-A-0,285,402 and EP-A-0,303,343. Another technique is to introduce a variable voltage level into a strobe prepulse whose purpose is to modify the liquid crystal material operating parameters so that it continues to operate over a wide temperature range, eg about 20° C., without need for compensation of Vs, Vd or line address time. This is described in GB 2.232.802. WO-A-92/02925.

SUMMARY OF THE INVENTION

According to this invention, the problem of temperature compensation is solved by varying the time length of a strobe pulse, whilst maintaining the same time between application of strobe to successively addressed rows (ie the data waveform period or line address time), in accordance with changes in liquid crystal material temperature.

According to this invention a method of temperature compensating a multiplex addressed ferro electric liquid crystal matrix display comprises the steps of providing a liquid crystal cell with cell walls enclosing a layer of ferroelectric liquid crystal material;

providing a first set of electrodes on one cell wall and a second set of electrodes on the other cell wall, the electrodes forming by their intersections a matrix of addressable elements:

addressing sequentially each electrode individually in the first set of electrodes, such addressing being either by application of a strobe waveform of pulses of positive and negative values, or by application of a blanking pulse followed by a strobe pulse and arranged to maintain a net zero d.c. value, applying one of two data waveforms to each electrode in the second set of electrodes synchronised with the strobe waveform, both data waveforms comprising pulses of positive and negative values each pulse lasting a time period of one time slot (ts) with one data waveform the inverse of the other data waveform, Characterised by:

the temperature of the liquid crystal material, varying the time length of the strobe waveform in accordance with the measured liquid crystal temperature whilst maintaining the same time between application of strobe waveform to successively addressed electrodes in the second set of electrodes and maintaining the same time periods (ts) in the data waveform.

whereby temperature induced changes in the liquid crystal material parameters are compensated.

The time between application of strobe waveform to successive rows is the data waveform period, eg may be 2 ts or 4 ts depending upon the type of addressing scheme. Often the data waveform period is referred to as the line addressing time, which when multiplied by the number of lines in a display, gives a frame time.

The strobe waveform may be in two parts, a first part which may be a zero in the first period, ts, immediately followed by a second part namely a non zero voltage (main) pulse for a significant portion of ts or greater than ts, eg (0.25, 0.5. 1.0, 1.5, 2.0, 2.5, 3.0 or more) x.ts. The second part of the strobe waveform lasts sufficiently long to provide ( in combination with the first part of the strobe waveforms and the data waveforms) switching of the liquid crystal material. For example the second part of the strobe waveform may be about 0.25 ts upwards, typically 0.5 ts upwards. The length of the second part of the strobe waveform may be continuously variable, or variable in steps of eg 0.5 ts or 1.ts.

Additionally, the strobe waveform may have a non zero voltage in the first ts period of the same or different polarity to the remainder of the strobe to provide additional temperature compensation.

The liquid crystal material may be switched between its two states by coincidence of a strobe pulse and an appropriate data waveform. Alternatively the material may be switched into one of its states by a blanking pulse and subsequently selected pixels switched back to the other state by coincidence of a strobe pulse and an appropriate data waveform.

The blanking pulse may be in one or two parts. For a two part blanking pulse the first part is of opposite polarity to the second; the two parts of the blanking pulse are arranged to have a voltage time product Vt that combines with the Vt product of the single strobe to give a net zero d.c. value.

According to this invention a temperature compensated multiplex addressed liquid crystal display comprises:

a liquid crystal cell formed by a layer of liquid crystal material contained between two cell walls, the liquid crystal material being a tilted chiral smectic material, the cell walls carrying electrodes formed as a first series of electrodes on one wall and a second series of electrodes on the other cell walls, the electrodes being arranged to form collectively a matrix of addressable intersections, at least one of the cell walls being surface treated to provide surface alignment to liquid crystal molecules along a single direction;

means for generating a strobe waveform comprising dc pulses of positive and negative values;

driver circuits for applying the strobe waveform in sequence to each electrode in the first set of electrodes;

means for generating two sets of data waveforms of equal amplitude and frequency but opposite sign, each data waveform comprising dc pulses of positive and negative values lasting a time period of one time slot (ts);

driver circuits for applying the data waveforms to the second set of electrodes:

and means for controlling the order of data waveforms so that a desired display pattern is obtained and an overall net zero de level;

Characterised by:

means for measuring the temperature of the liquid crystal material:

means for varying the length of at least one pulse in the strobe waveform, relative to the period of the data waveforms without changing the data waveform time periods (ts), in accordance with the measured liquid crystal temperature to compensate for changes in liquid crystal material parameters with temperature.

BRIEF DESCRIPTION OF THE DRAWINGS

The invention will now be described by way of example only with reference to the accompanying drawings of which.

DETAILED DESCRIPTION OF PREFERRED EMBODIMENTS

Figure 1:
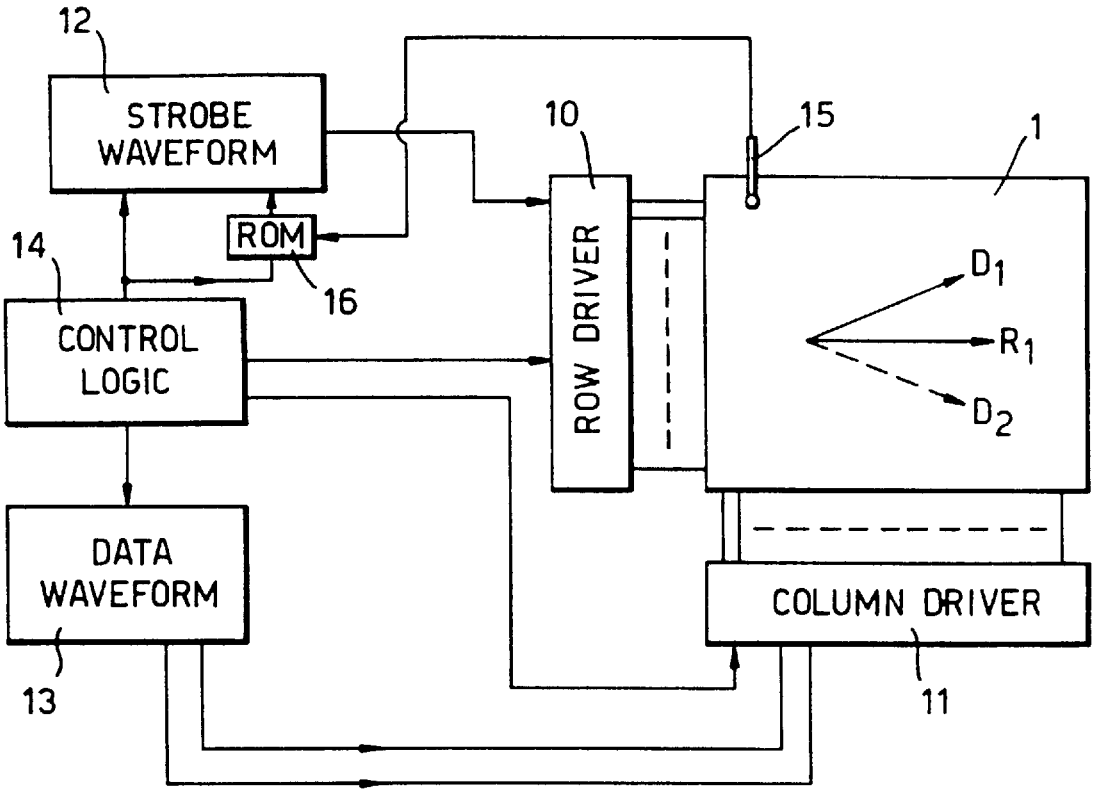
FIG. 1 is a diagrammatic view of a time multiplex addressed x, y matrix.
Figure 2:
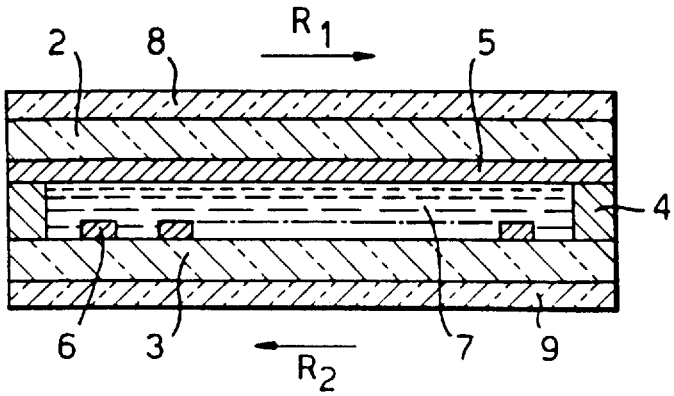
FIG. 2 is a cross section of part of the display of FIG. 1 to an enlarged scale.

The display 1 shown in FIGS. 1, 2 comprises two glass walls 2, 3 spaced about 1–6 μm apart by a spacer ring 4 and/or distributed spacers. Electrode structures 5, 6 of transparent tin oxide or indium tine oxide (ITO) are formed on the inner face of both walls. These electrodes are shown as row and column forming an X, Y matrix but may be of other forms. For example, radial and curved shape for an r, θ display, or of segments form for a digital seven bar display. A layer 7 of liquid crystal material is contained between the walls 2, 3 and spacer ring 4.

Polarisers 8, 9 are arranged in front of and behind the cell 1. Row 10 and column 11 drivers apply voltage signals to the cell. Two sets of waveforms are generated for supplying the row and column drivers 10, 11. A strobe wave form generator 12 supplies row waveforms, and a data waveform generator 13 supplies ON and OFF waveforms to the column drivers 11. Overall control of timing and display format is controlled by a control logic unit 14. Temperature of the liquid crystal layer 7 is measured by a thermocouple 15 whose output is fed to the strobe generator 12. The thermocouple 15 output may be direct to the generator or via a proportioning element 16 e.g. a programmed ROM chip to vary one part of the strobe pulse and or data waveform.

Prior to assembly the cell walls are surface treated in a known manner, e.g. by applying a thin layer of polyimide or polyamide, drying and, where appropriate, curing and buffing with a cloth (e.g. rayon) in a single direction, R1, R2. Alternatively a thin layer of e.g. silicon monoxide may be evaporated at an oblique angle. These treatments provide a surface alignment for the liquid crystal molecules. The alignment/rubbing directions R1, R2 may be parallel or anti parallel. When suitable unidirectional voltages are applied the molecules director align along one of two directions D1, D2 depending on polarity of the voltage. Ideally the angle between D1, D2 is about 45°. In the absence of an applied electric field the molecules adopt an intermediate alignment direction between R1, R2 and the directions D1, D2.

The device may operate in a transmissive or reflective mode. In the former light passing through the device e.g. from a tungsten bulb is selectively transmitted or blocked to form the desired display. In the reflective mode a mirror is placed behind the second polariser 9 to reflect ambient light back through the cell 1 and two polarisers. By making the mirror partly reflecting the device may be operated both in a transmissive and reflective mode.

Pleochroic dyes may be added to the material 7. In this case only one polariser is needed and the layer thickness may be 4–10 μm. Some suitable mixtures are given below.

Liquid crystal material at an intersection of a row and column electrode is switched by application of an addressing voltage. This addressing voltage is obtained by the combination of applying a strobe waveform Vs to the row electrode, and a data waveform Vd to the column electrode. ie:

$$Vr=Vs-Vd$$

where

Vr=instantaneous value of addressing waveform

Vs=instantaneous value of strobe waveform, and

Vd=instantaneous value of data waveform

Figure 5:
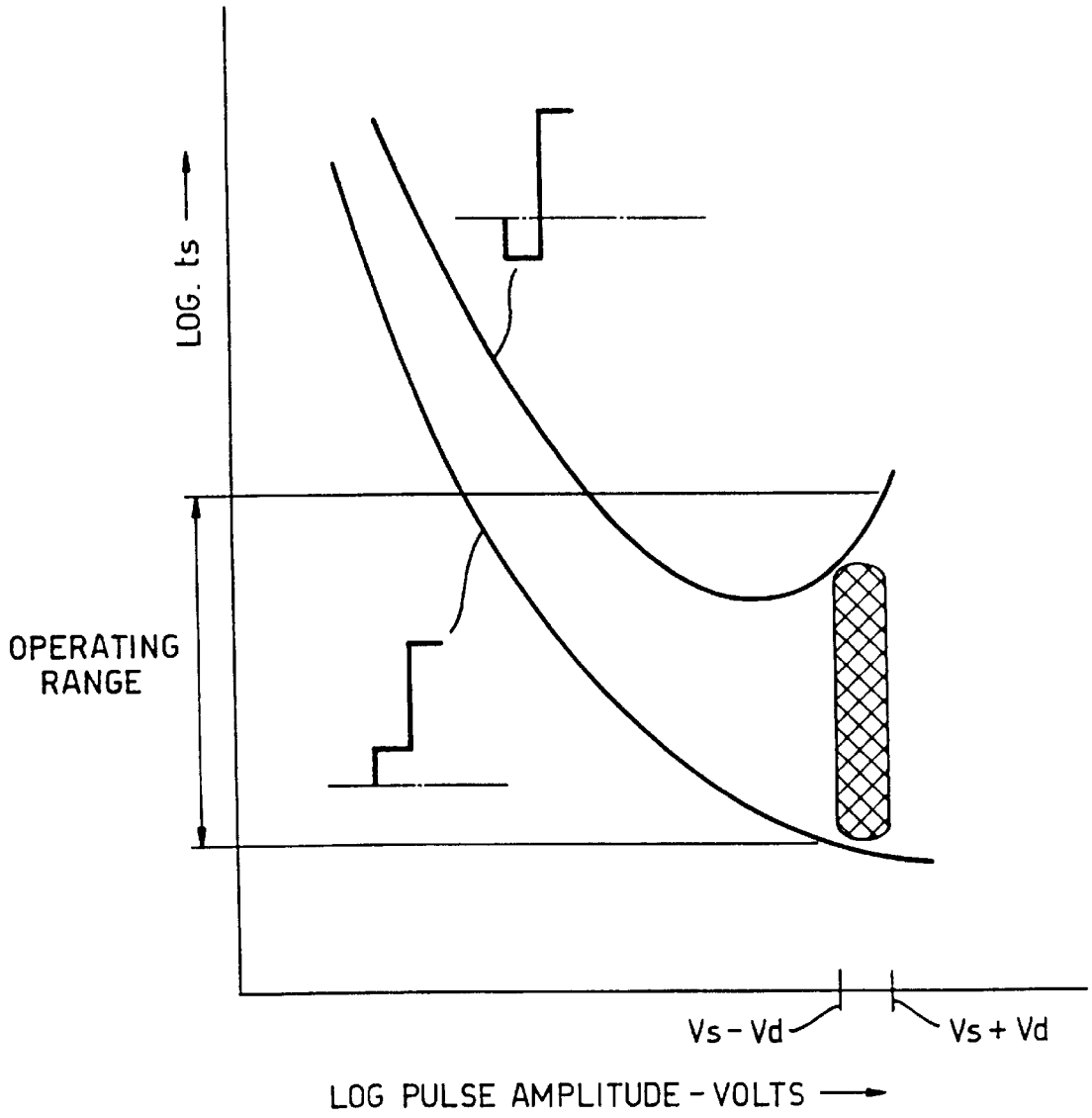
FIG. 5 is a graph of log time against log voltage showing switching characteristics of a smectic material for two differently shaped addressing waveforms.

Chiral tilted smectic materials switch on the product of voltage and time. This characteristic is shown in FIG. 5. Voltage time products above the curve will switch a material; below the curve is a non-switching regime. Note, the switching characteristic is independent of the sign of the voltage; i.e. the material switches for either a positive or a negative voltage of a given amplitude. The direction to which the material switches is dependent on the polarity of voltage.

Two curves are shown in FIG. 5 because the switching characteristic depends upon the shape of the addressing voltage pulse combination. The upper curve is obtained when the addressing voltage is immediately preceded by a small prepulse of opposite sign; e.g. a small negative pulse followed by a larger positive pulse. The material behaves the same on application of a small positive pulse followed by a large negative pulse. This upper curve usually exhibits a turn round or a minimum response time at one voltage. The small prepulse may be termed a leading pulse (Lp) and the larger addressing pulse a trailing pulse (Tp). The upper curve applies for a negative value of the ratio Lp/Tp.

The lower curve is obtained when the addressing voltage is immediately preceded by a small pre-pulse of the same sign; i.e. a small positive pulse followed by a larger positive pulse. The same applies for a small negative pulse followed by a large negative pulse. The lower curve has a positive Lp/Tp ratio. This lower curve has a different shape to that of the upper curve; for some materials it may not have a minimum value of a voltage time curve.

The difference in shape between the two curves allows a device to be operated without ambiguity over quite a wide range of time values. This is obtained by operating a device in a regime between the two curves e.g. as shown in hatched lines. Intersections required to be switched are addressed by an addressing voltage having a shape where the lower curve applies and where the voltage and pulse width lie above the curve. Intersections not requiring to be switched either receive an addressing voltage having the shape where the upper curve applies, and where the voltage and pulse width lie below the curve, or only receive a data waveform voltage. This is described in more detail below.

Figure 11:
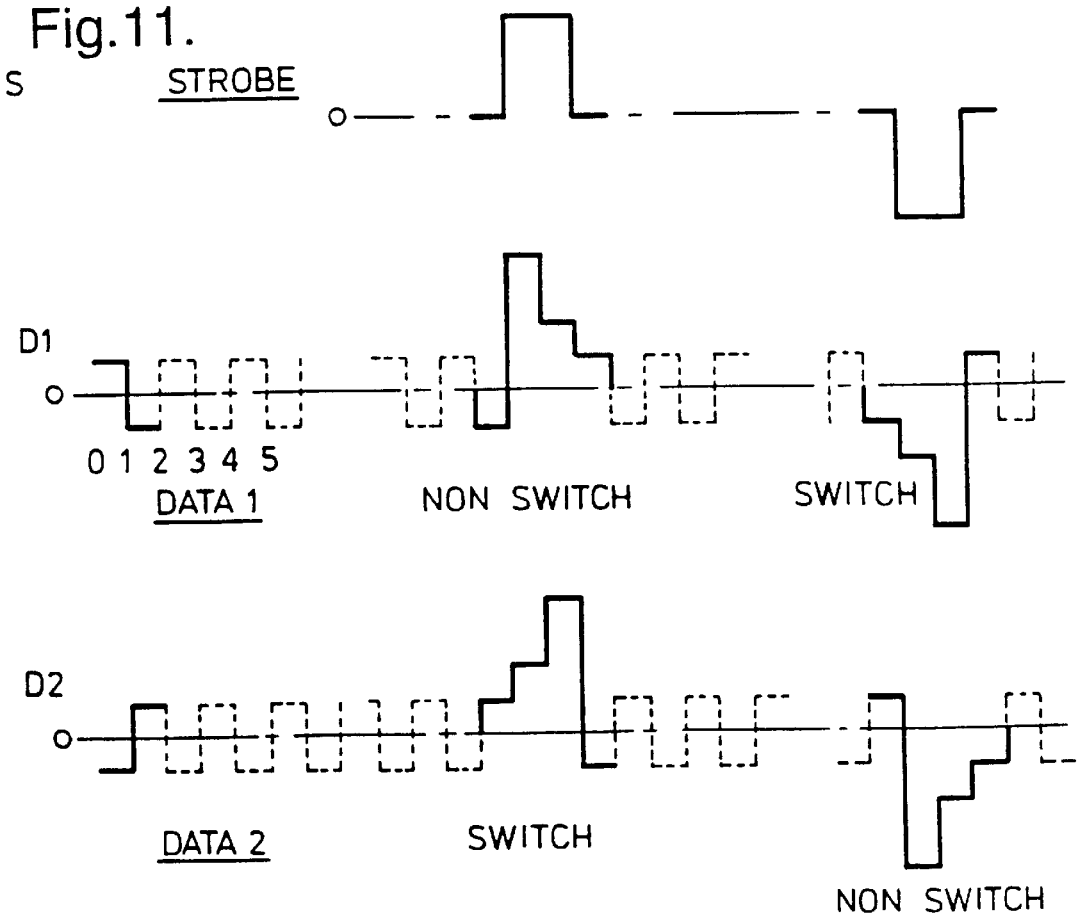

FIG. 11 shows strobe, data, and addressing waveforms of one embodiment of the present invention where strobe pulses applied to one row extend into the addressing of the following row. The strobe waveform is first a zero for a time period ts followed by +3 for twice ts. This is applied to each row in sequence, i.e. one time frame period. The second part of the strobe is a zero for one ts period followed by +3 for twice ts. Again this is applied to each row in sequence for one time frame period. Complete addressing of a display takes two time frame periods. The values of +3, −3 are units of voltage given for the purpose of illustration, actual values are given later for specific materials.

Data waveforms are arbitrarily defined as data ON and data OFF, or D1, and D2. Data ON has first a value of +1 for a first time period of ts followed by a −1 for a time period ts. This is repeated; i.e. data ON is an alternating signal of amplitude 1 and period 2 ts. Data OFF is similar but has an inital value of −1 followed by +1 ; i.e. the inverse of data ON. The first part of the data waveform, e.g. for data ON the value of +1 for a time period ts, is coincident with the first part of the strobe waveform, i.e. zero for time period ts.

The addressing waveform is the sum of strobe and data. The combination of a positive strobe pulse and data ON is: −1, 4, 2, 1, −1, 1 etc. The value 4 immediately preceded by −1 ensures the material switch characteristics are governed by the upper curve of FIG. 5. The combination of a negative strobe pulse and data ON is: −1, −2, −4, 1, −1, 1 etc. The combination of smaller pulses of the same sign as the large (−4) pulse ensures the material switch characteristics are governed by the lower curve in FIG. 5. Similarly a positive strobe pulse and data OFF combine to give: 1, 2, 4, −1, 1 etc; and a negative strobe pulse and data OFF combine to give: 1, −4, −2, −1, 1, −1 etc.

When not receiving a strobe pulse each row receives a zero voltage. Each column receives either data ON or data OFF throughout. The effect is that all intersections receive an alternating signal, caused by the data waveforms, when not being addressed. This provides an a.c. bias to each intersection and helps maintain material in its switched state. Larger amounts of a.c. bias lead to improved contrast by the known a.c. stabilisation described in Proc 4th IDRC 1984, pp 217–220.

Further a.c. bias may be provided, e.g. from a 50 KHz source, direct onto those rows not receiving a strobe pulse.

Figure 10:
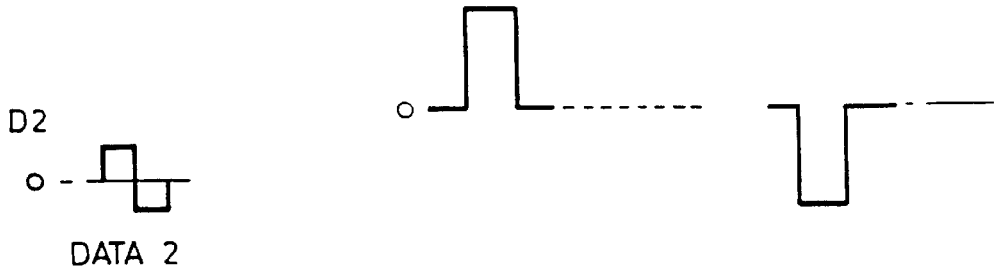
Figure 12:
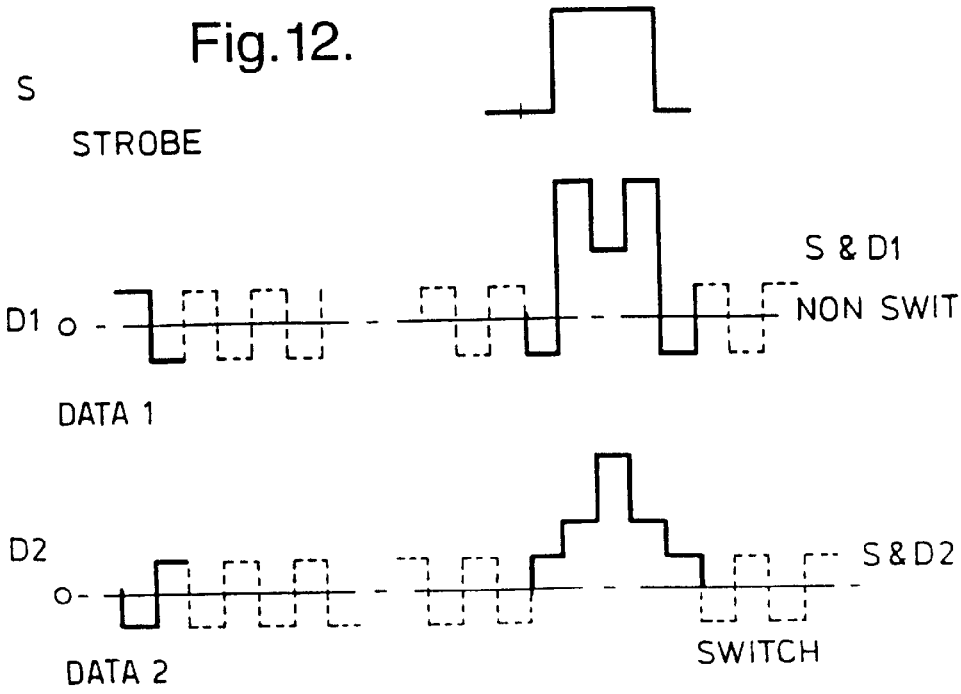
Figure 13:
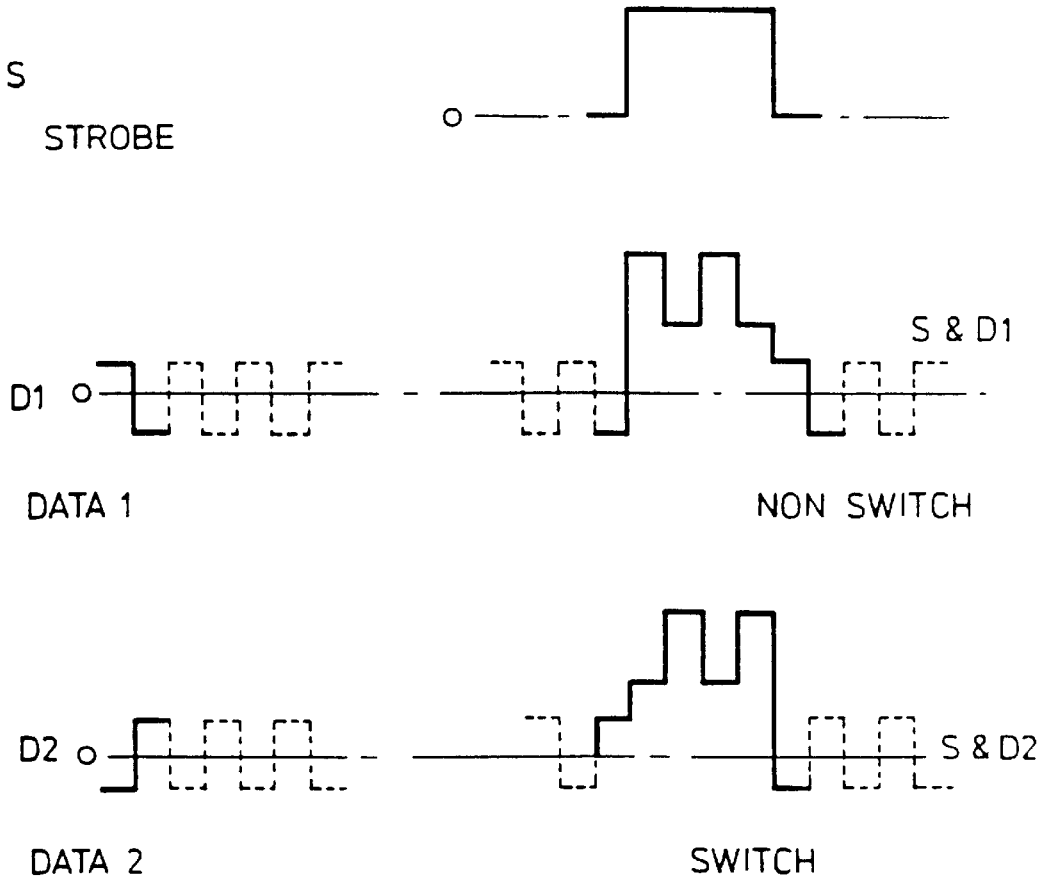

Alternative extended strobe waveforms are shown in FIGS. 10, 12, 13. In FIG. 10 the strobe is first a zero for 1 ts and +3 for 1.5 ts, followed by its inverse. In FIG. 12 the strobe is first a zero for 1×tsh and 3 for 3×ts, followed by its inverse. In FIG. 13 the strobe waveforms is first a zero for 1×ts and 3 for 4×ts, followed by its inverse.

Figure 8:
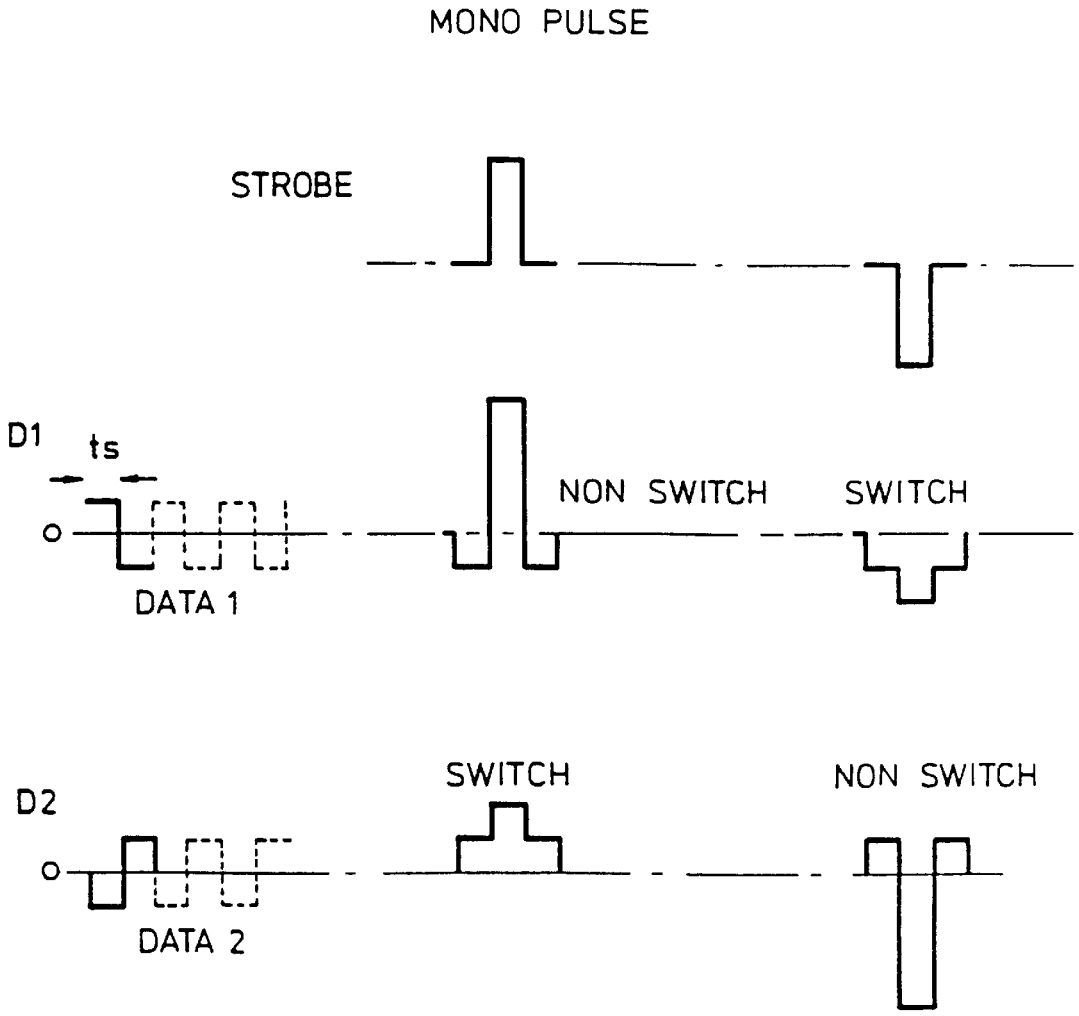
FIGS. 8–14 show different strobe and data waveform diagrams for an addressing scheme using a two time slot data waveform.

FIG. 8 shows strobe, data, and resultant addressing waveforms where the strobe does not intrude into the next raw addressing time. As shown the strobe is a zero for 1 ts followed by +3 for 1 ts. The inverse is applied in the following field time. In this example the strobe and data waveforms have the same period of 2 ts. Resultant waveforms for the four different combination of strobe and data waveforms are shown. Switching occurs when a larger pulse is preceded by a smaller pulse of the same polarity.

Figure 9:
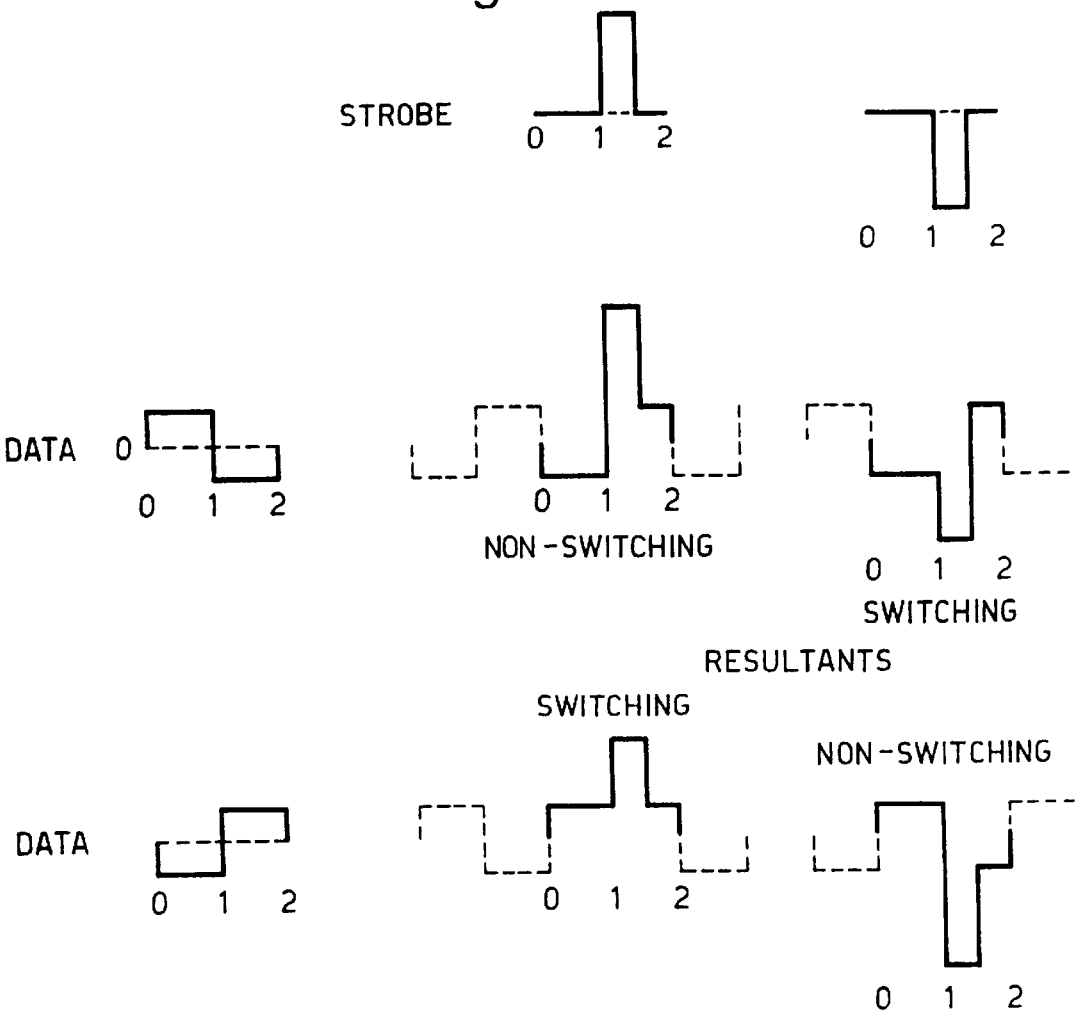

FIG. 9 shows strobe, data, and resultant addressing waveforms where the non-zero voltage part of a strobe waveform is less than a single time slot 1.ts. The strobe waveform is a zero for 1.ts, then +3 for 0.5 ts, followed by zero for the remainder of ts. Resultant waveforms for the four different combination of strobe and data waveforms are shown. As in FIG. 8, switching occurs when a larger pulse is preceded by a smaller pulse of the same polarity.

An alternative to using two strobe pulses of opposite polarity is to blank all pixels to one state, then selectively switch with strobe pulses to the other state. This may require periodic polarity inverting to maintain net zero dc.

Figure 14:
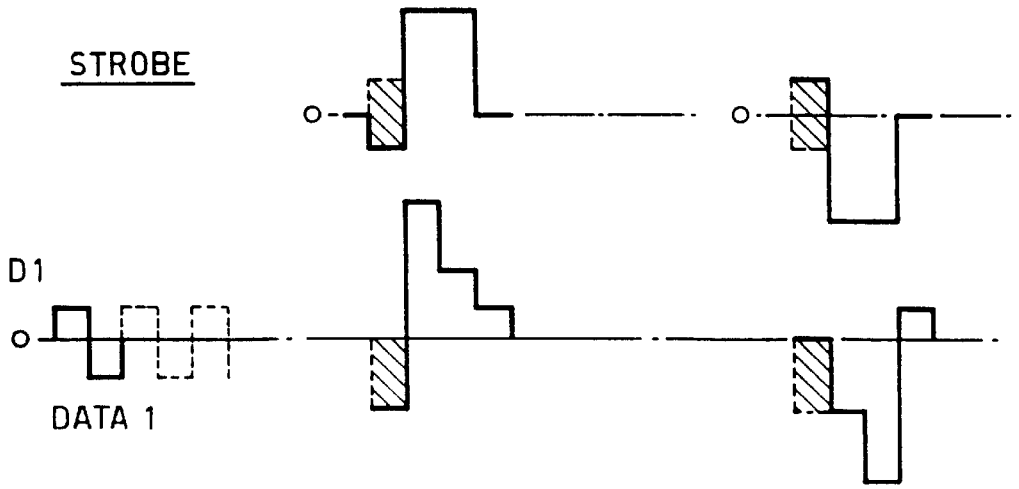
Figure 15:
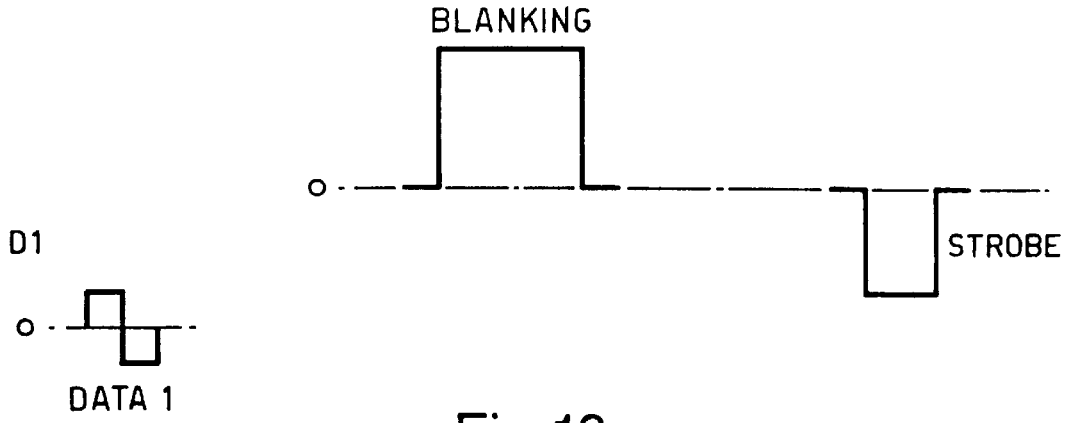
FIGS. 15, 16 show blanking, strobe and data waveforms diagrams for an addressing scheme using a two time slot data waveform.

FIG. 15 shows a single blanking pulse of amplitude 4 applied for 4 ts. This switches all the intersections to one switched state. A strobe (as in FIG. 11) is then used to switch selected intersections to the other switched state. Periodically the sign of the blanking and strobe are reversed to maintain overall net zero d.c. voltages. The use of a blanking pulse and single strobe can be applied to all the schemes of FIGS. 8–14. An advantage of blanking and strobe systems is that the whole display can be addressed in a single field time period.

Figure 16:
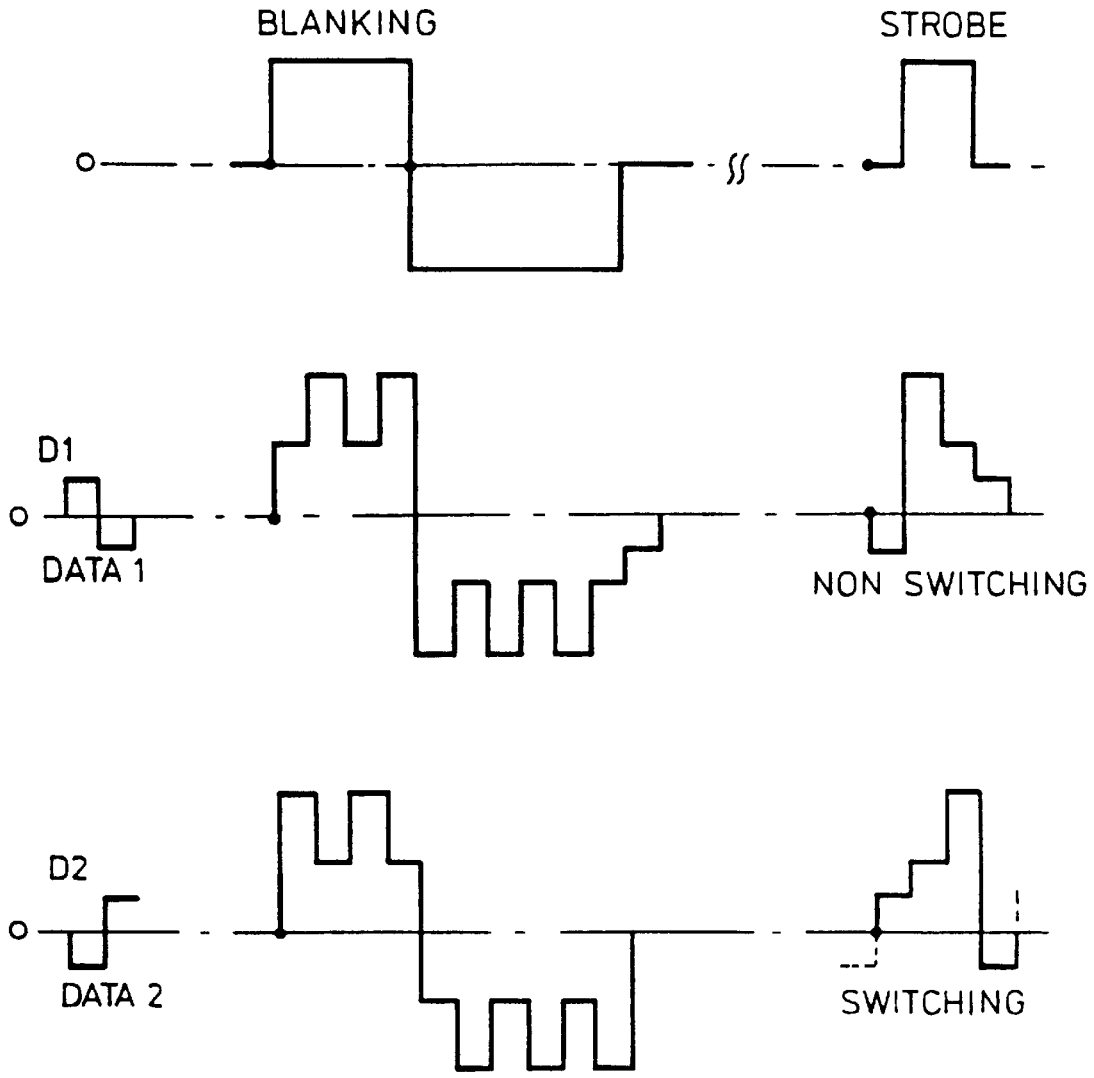

An alternative blanking scheme is shown in FIG. 16 where the blanking pulse is in two parts. The first part is +3 for 4 ts immediately followed by −3 for 6 ts forming the second part. These two pulses are dc balanced with a single strobe of +3 for 2 ts The blanking pulse may precede the strobe pulse by a variable amount but there is an optimum position for response time, contrast and visible flicker in the display. This is typically with a blanking pulse starting six lines ahead of the strobe pulse but is dependent upon material parameters and the detail of the multiplex scheme.

Figure 18:
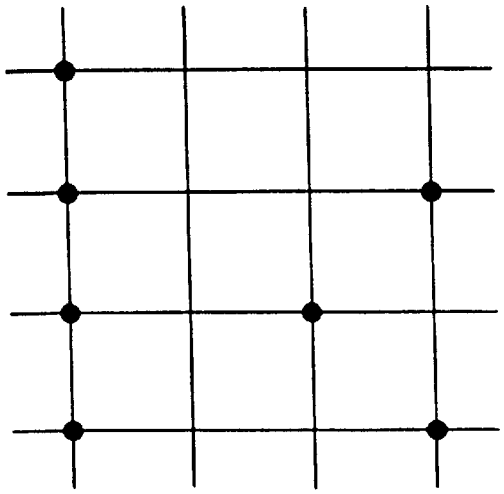
FIG. 18 shows one example of a pattern of information on a 4×4 element array where some intersections are switched to an ON state, indicated by solid circles, with the remainder in an OFF state.
Figure 19:
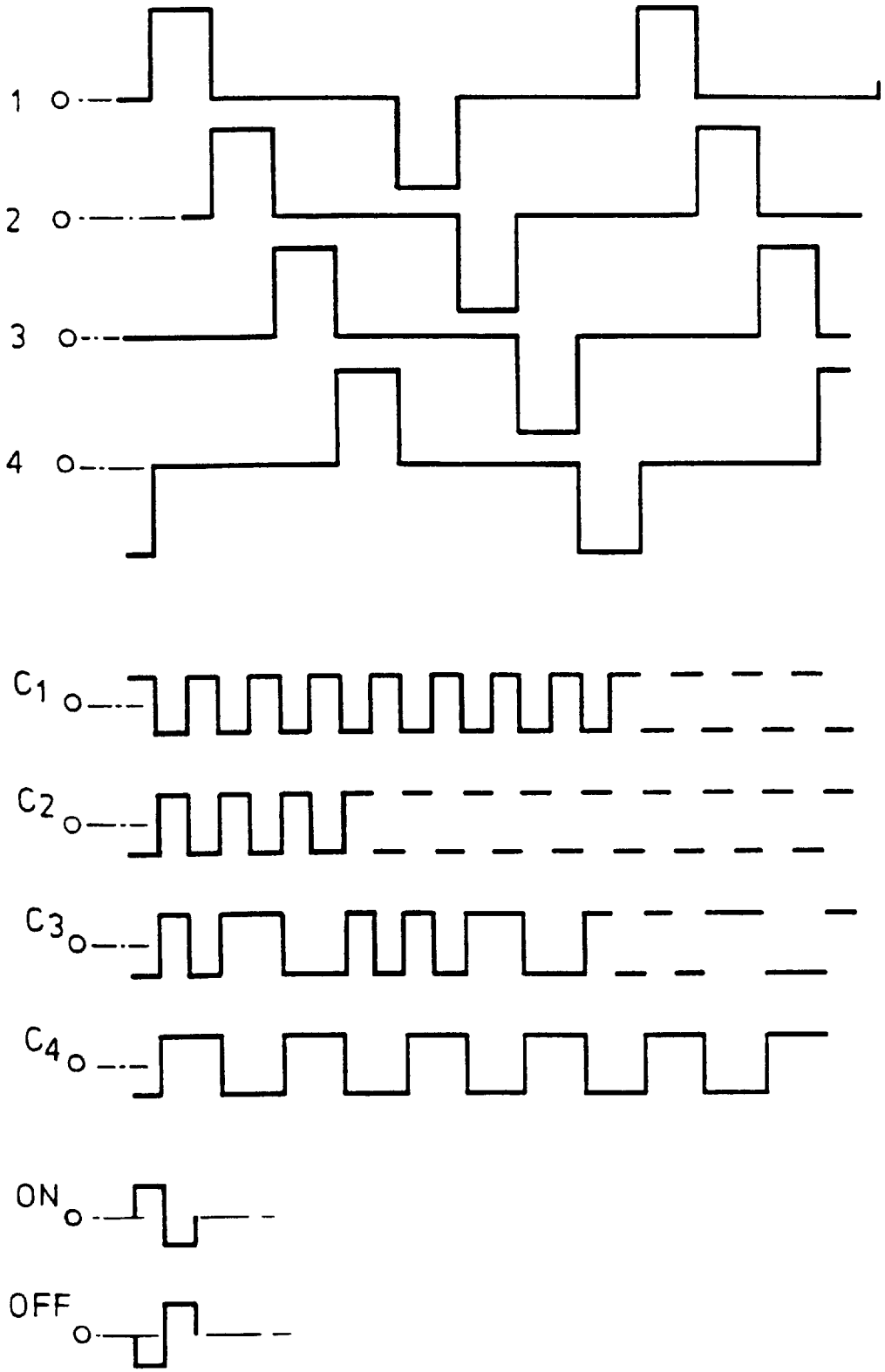
FIGS. 19,20 show waveform diagrams for addressing the 4 x 4 element display shown in FIG. 18 with the strobe and data waveforms shown in FIG. 11.
Figure 20:
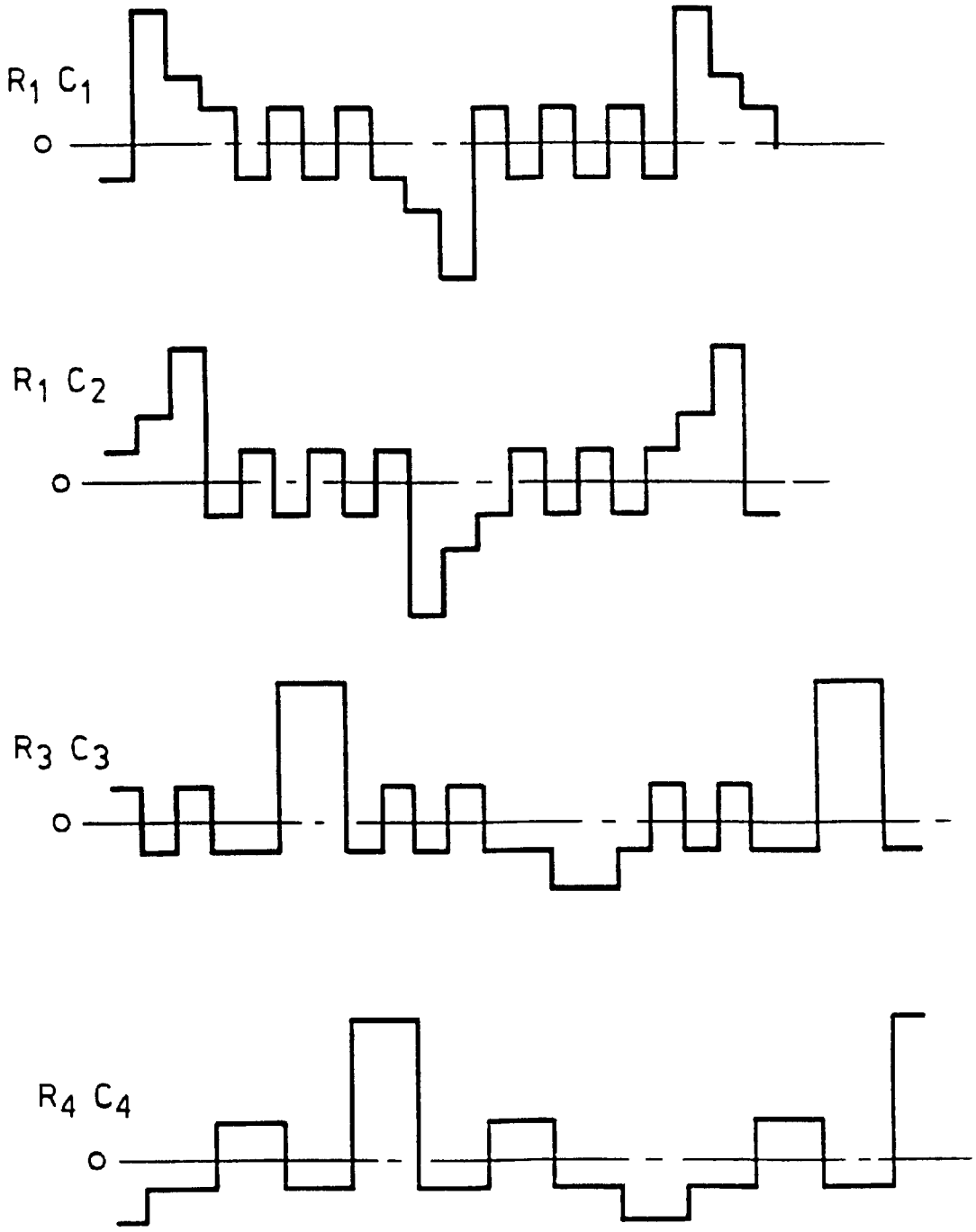

FIGS. 19, 20 show the waveforms involved in addressing a 4×4 matrix array showing information as shown in FIG. 18. Solid circles are arbitrarily shown as ON electrode intersections, i.e. display elements, unmarked intersections are OFF. The addressing scheme is that used in FIG. 11.

The positive strobe pulse is applied to each row 1 to 4 in turn; this comprises the first field. After the last row is addressed by the positive strobe pulse the negative strobe pulse is applied to each row 1 to 4 in turn and comprises the second field. Note there is an overlap between rows. For example the third ts period for row 1 occurs at the same as the first ts period of row 2. This overlap is more noticable for displays using the strobe waveforms shown in FIGS. 12, 13.

The data waveform data ON applied to column 1 remains constant because each intersection in column is always ON. Similarly for column 2 the data waveform is data OFF and remains constant because all intersections in column 2 are OFF. For column 3 the data waveform is data OFF whilst rows 1 and 2 are addressed, changing to data ON whilst row 3 is addressed, then changing back to data OFF whilst row 4 is addressed. This means that column 3 receives data OFF for 4×ts, data ON for 2×ts, data OFF for 2×ts, a period of one field time, the time taken for the positive strobe pulse to address every row. Similarly for column 4 the data waveform is data OFF for 2 ts, data ON for 2 ts, data OFF for 2 ts, and data ON for 2 ts. This is repeated for a further field period whilst the negative strobe pulse is applied. Two field periods are required to provide one frame period and completely address the display. The above is repeated until a new display pattern is needed.

Resulting addressing waveforms are shown in FIG. 20. For intersection row 1 column 1 (R1,C1) the material does not switch during the first field period because the material switching follows the upper curve of FIG. 5, and time and applied voltage level are made to lie below the switching curve. Instead the material switches during the second field period where the material switches because of the lower voltage/time requirements shown by the lower curve of FIG. 5. A similar reasoning applies to intersection R1,C2 where the material switches during the first field period.

For intersection R3,C3 the material switches during the second field period because the time/voltage applied during the first field period does not reach the higher value required by the upper curve of FIG. 5. Intersection R4,C4 switches at the end of the second field period whilst a negative strobe pulse is being applied.

When the display of FIGS. 1, 2 is in use the temperature of the liquid crystal material may change; this results in a change of the switching characteristics. Small temperature changes can be compensated for by small changes in the amplitude and sign of the first pulse in the strobe as shown in FIG. 14. Also the value of ts may be varied to provide some temperature compensation. Larger temperature changes are compensated for by varying the length of the strobe waveform as shown in FIG. 17.

Figure 6:
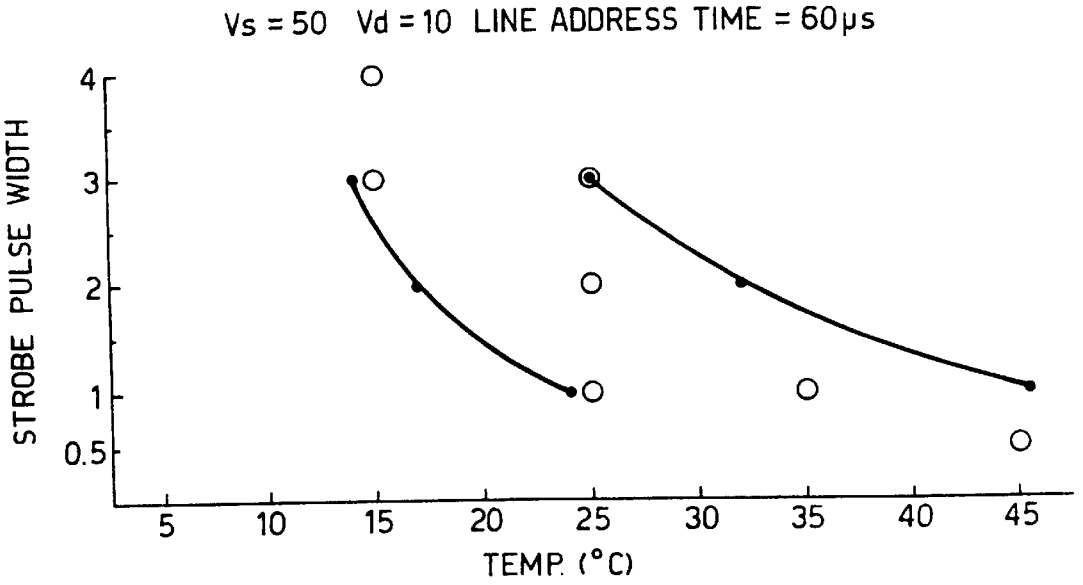
FIGS. 6, 7 are graphs showing the limits of strobe waveform pulse length against temperature for one liquid crystal composition, with different addressing voltages and times.
Figure 7:
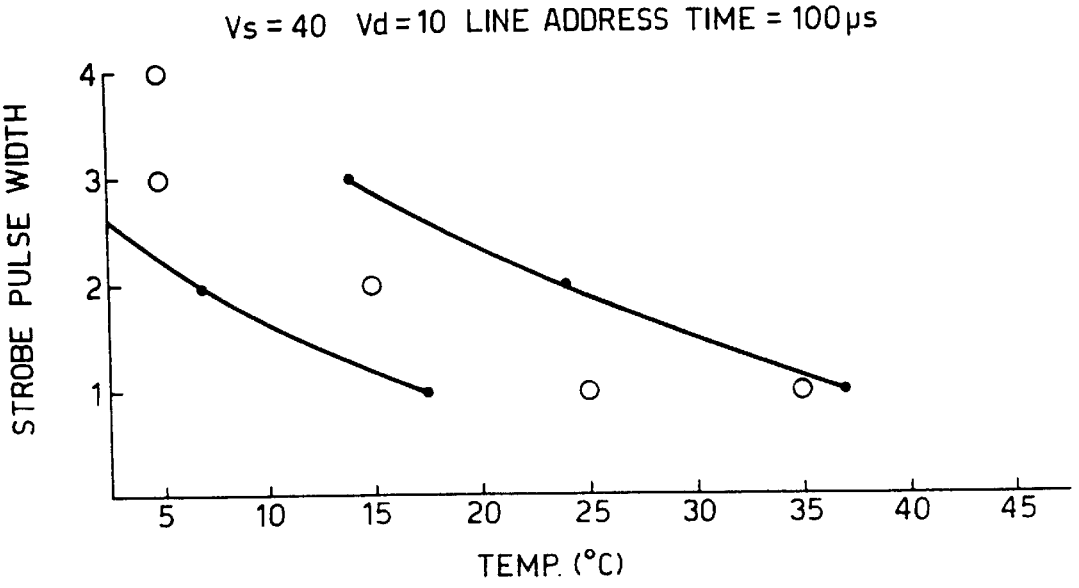
Figure 17:
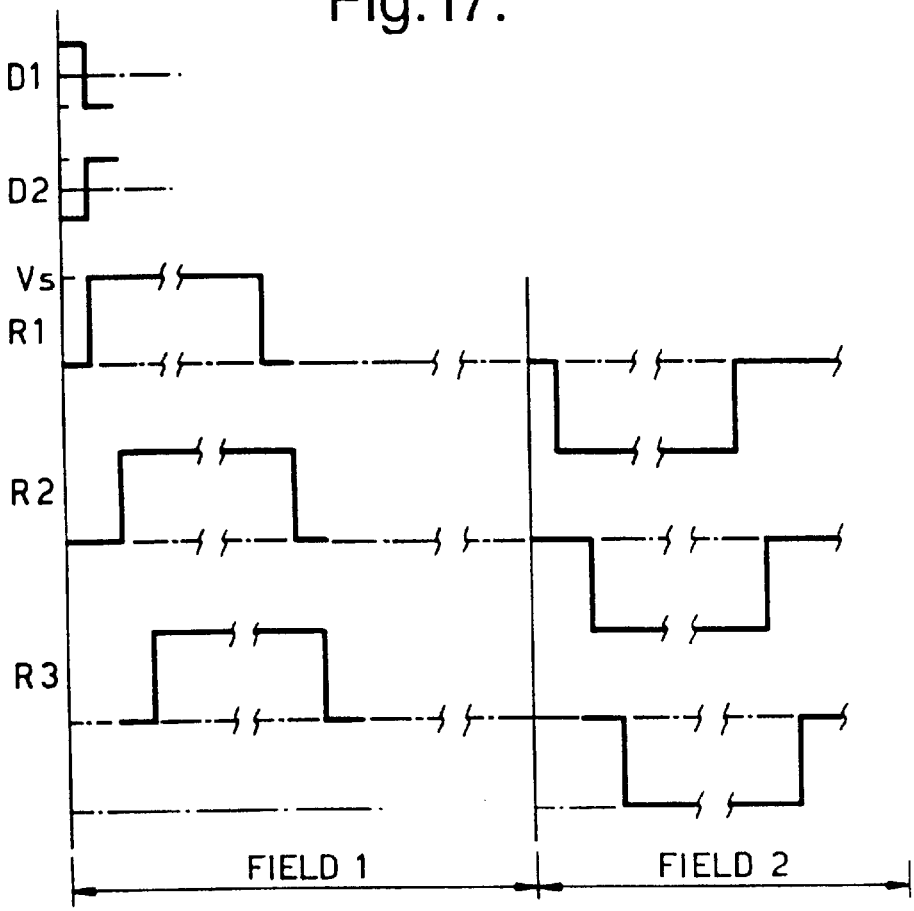
FIG. 17 shows strobe waveforms whose length is variable over the range of values shown in for the strobe in FIGS. 8–16.

As shown in FIG. 17 the strobe pulse is first zero for its, followed by n.ts where n is a number greater than about 0.25 ts and is varied with measured temperature as shown in FIGS. 6, 7. The sign of the strobe pulse is alternated in successive frames to achieve net zero dc. The value of n may be a number of system clock pulse times, each much smaller than ts, to give a smooth change of strobe pulse length. Alternatively n may be adjusted in steps of eg 0.5 ts or an integer number of ts values.

FIGS. 8–13 above show how the display may be addressed with strobe pulses of different lengths. FIGS. 6, 7 show how the length of the strobe pulse needs to be changed to compensate for temperature for one specific material. The material used for FIGS. 6, 7 was Merck ZLI 5014-000 in a 1.8 μm thick layer. For FIG. 6 the strobe voltage was 50 volts, data voltage 10 volts, data period (2.ts) 60 μs. For FIG. 7 the strobe was 40 volts, data 10 volts, and data period 100 μs. In the FIGS. 6, 7 the vertical axis shows the length of the second part of the strobe waveform, and the horizontal axis material temperature. As shown in FIG. 6, temperature compensation is obtainable from just below 15° C. to over 45° C. In FIG. 7 the temperature compensation is obtained from below 5° C. to over 35° C.

Tables 1, 2 show ranges of temperature compensation for the material of FIGS. 6, 7 with different drive conditions. By way of comparison, details are also given of operating temperature range with no compensation and temperature compensation range obtained by varying the length of the data period 2.ts. Varying strobe waveform can provide temperature compensation of a range of greater than 30° C., whereas varying the length of ts provides temperature compensation over a range of 25° C.

TABLE 1

Material Merck ZLI 5014-000. in a 1.8 μm thick layer.
Vs = 50v, Vd = +/− 10v, data waveform period = 60 μs.

| | Temp range | ΔT | Data waveform change of 2X | |
|---|---|---|---|---|
| Drive Scheme | (°C.) | (°C.) | Temp Range °C. | ΔT |
| FIG. 8 | 24–45.5 | 21.5 | 24–49 | 25 |
| FIG. 11 | 17–31.5 | 14.5 | 17–36.5 | 19.5 |
| FIG. 12 | 14–25 | 11 | 14–31.5 | 17.5 |

TABLE 2

Material Merck ZLI 5014-000, in a 1.8 μm thick layer.
Vs = 40v, Vd = +/− 10v, data waveform period = 100 μs.

| | Temp range | ΔT | Data waveform change of 2X | |
|---|---|---|---|---|
| Drive Scheme | (°C.) | (°C.) | Temp Range °C. | ΔT |
| FIG. 8 | 18–36.5 | 18.5 | 18–42.5 | 24.5 |
| FIG. 11 | 7–24 | 17 | 7–32 | 25 |
| FIG. 12 | <5–14 | 9 | <5–32 | 18 approx |

Thus as the liquid crystal material 7 temperature varies, the length of the strobe waveform is varied eg from that shown in FIG. 9, to that of FIG. 13, of length 5 ts, or longer. Circuitry for extending the strobe pulse length without changing line address time from 2 ts, is shown in FIGS. 3, 4.

Figure 3:
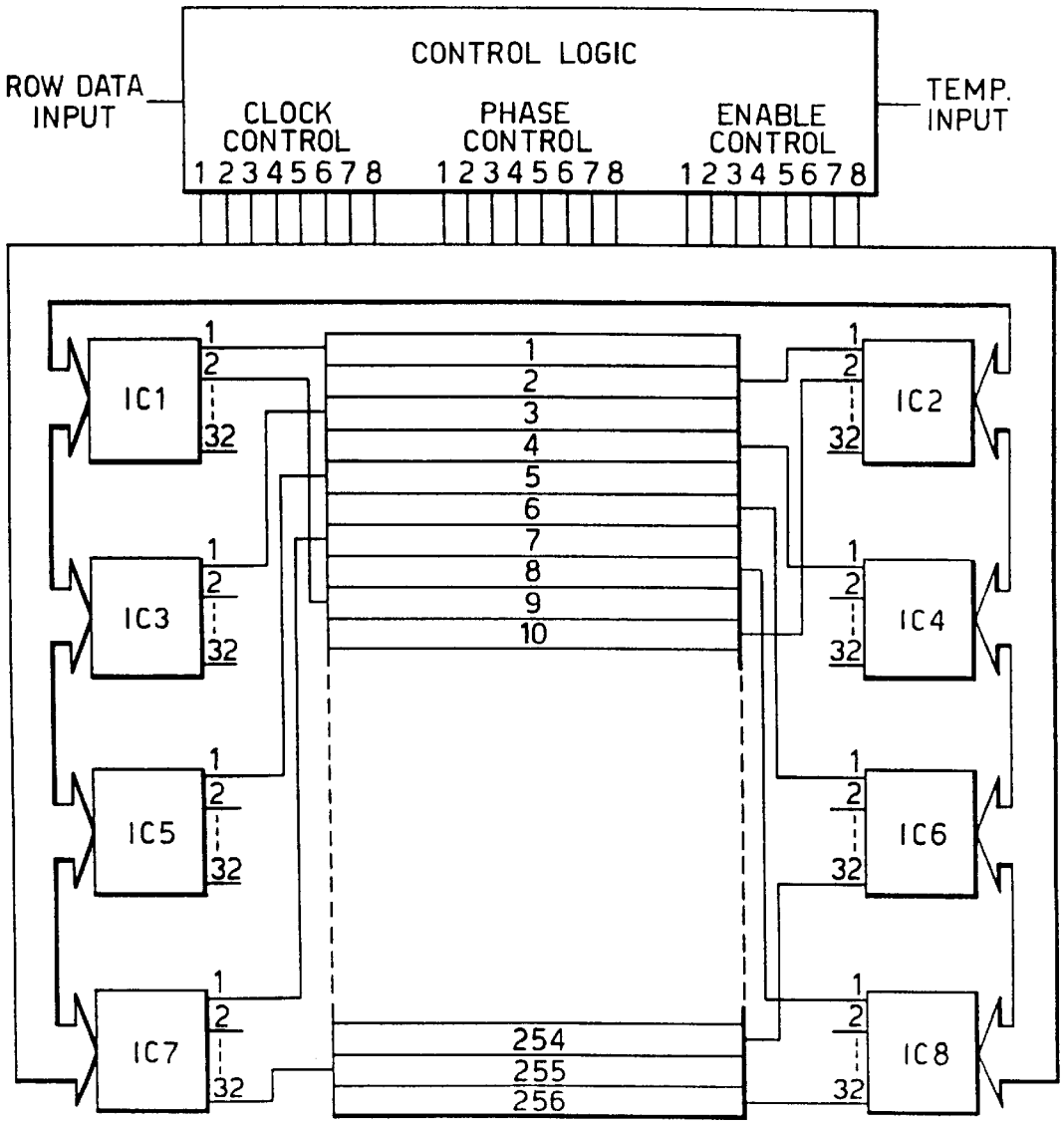
FIGS. 3,4 area block diagrams of part of FIG. 1 showing circuits for varying the length of the strobe pulses in response to measured device temperatures.

FIG. 3 shows a part of FIG. 1 to an enlarged scale, only row electrodes and drivers are illustrated for simplicity. Rows R1 to R256 are connected to driver circuits IC1 to IC8; eg integrated circuits HV60 (obtainable from Supertex USA). Outputs 1–32 of IC1 are connected to rows R1, R9, R17 . . . R248. Similarly outputs 1–32 of IC2 are connected to rows R2, R10, R18, . . . R249, etc for all the ICs. A control logic has row waveform input, a temperature input from sensor 15, and clock phase and enable control outputs to a bus line connecting all the IC1–8.

A strobe waveform is clocked down each row in turn; first a zero voltage then a pulse of appropriate polarity for the longest pulse extension which might be required, eg 5 ts. The length of this pulse depends upon the sensed temperature. When each strobe pulse has been applied to a given row, the strobe amplitude value remains until the control logic signals an enabling signal which terminates the strobe at that row. All rows are addressed in the first field, then readdressed in a second field with the strobe polarity reversed; two fields of addressing make up a single frame addressing time. In this embodiment each IC is addressed in turn to give an output at its output 1. This is repeated for successive IC outputs 2–32.

Figure 4:
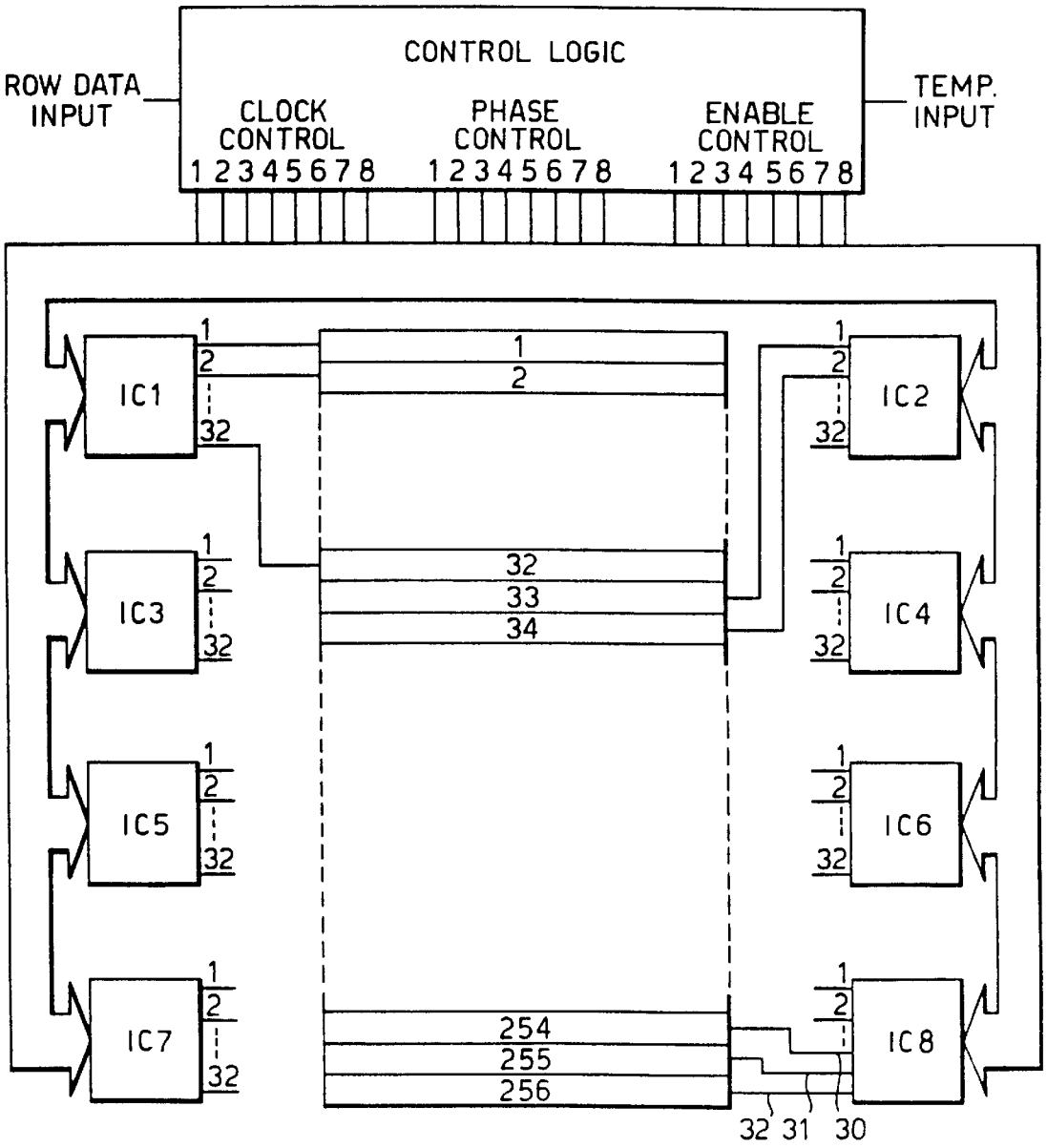

A different arrangement is shown in FIG. 4 which has the same components but differently connected to that of FIG. 3. In this FIG. 4 embodiment the output 1–32 of IC1 connect to rows R1 to R32, and outputs 1–32 of IC2 connect to rows R33 to R64 etc. An advantage of this arrangement is a reduced number of crossover of connecting leads. The rows are addressed non consecutively, ie rows R1, R33, R65 . . . R225, R2, R34, R66, . . . R226, R3, R35, R67, . . . R227, etc.

Figure 21:
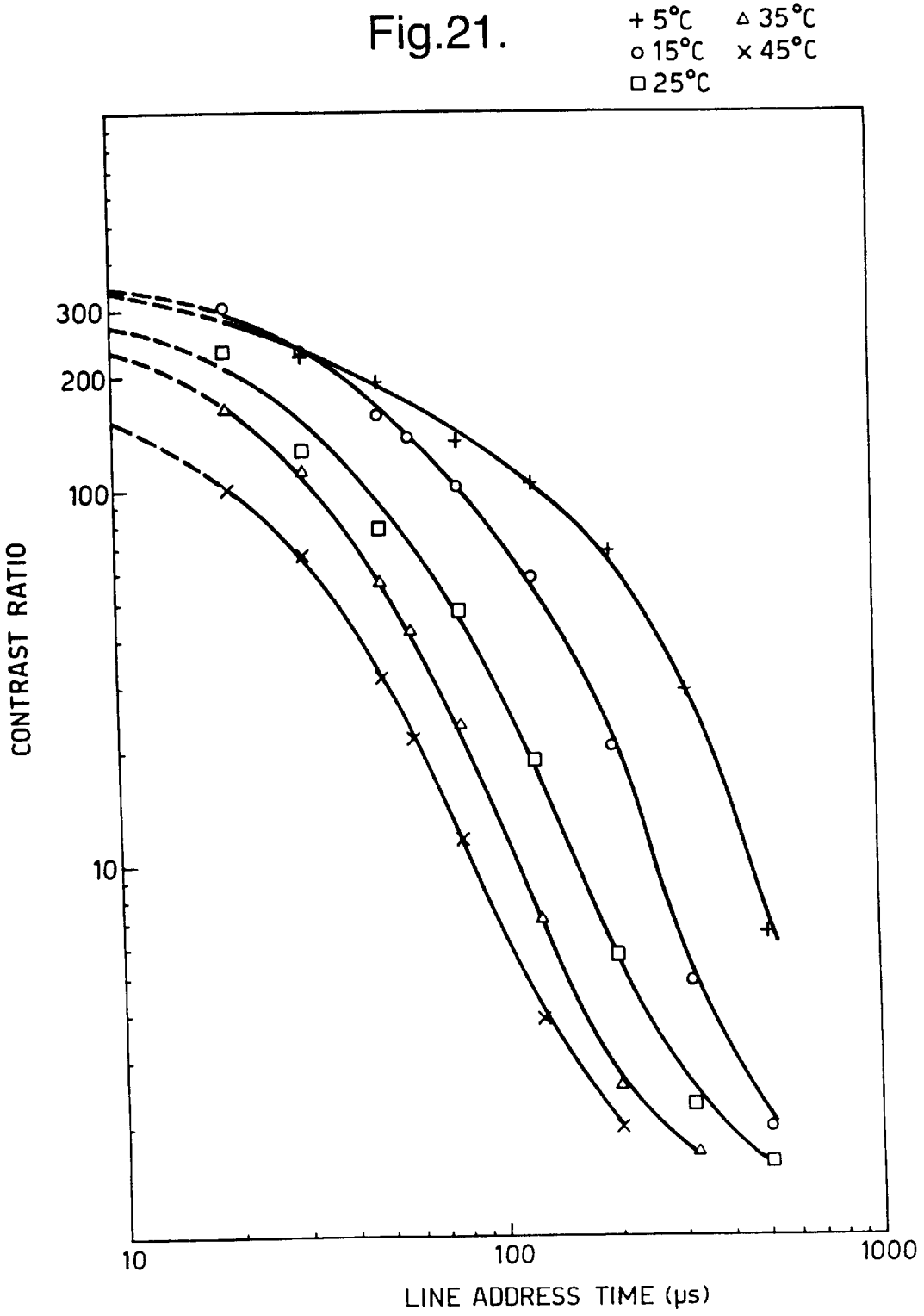
FIG. 21 shows variation of contrast ratio with data waveform period when using the drive scheme shown in FIG. 17.

In addition to varying the strobe pulse lengths, the amplitude and sign of the strobe prepulse. FIG. 14, and amplitude values of Vs and Vd may also be varied to provide temperature compensation. Further, the length of the time slots ts may also be varied. Variation is ts may improve contrast ratio between the two switched states as shown in FIG. 21. In this FIG. 21 contrast ratio dependence on period of applied ac square wave at +/−10 v data voltage are shown at five temperatures, 5° C., 15° C., 25° C., 35° C., and 45° C. for Merck ZLI 5014-000 in a 1.8 μm thick layer. To obtain the curves shown the device was switched between its two optical states with a monopolar strobe pulse of alternate polarites and sufficient voltage-time product and an ac square wave was superimposed to simulate the column waveforms of a multiplex drive scheme.

In nematic and ferroelectric liquid crystal devices it is known, eg GB 2,262,831, to reduce peak row and column voltages required at the driver circuits by applying additional voltage reduction waveforms (VRW) to both row and column electrodes. These VRWs combine at each addressed element to give the same resultant voltage as displays not using VRWs. Such VRWs may be applied to the waveforms of FIGS. 8–17 above.

The addressing schemes shown above with reference to FIGS. 8 to 17 involve variations on two time slot addressing; the data waveforms are pulses of alternating +/−Vd applied for one time slot. The principle of the present invention may also be applied to known addressing schemes which use a different number of time slots.

Figure 22:
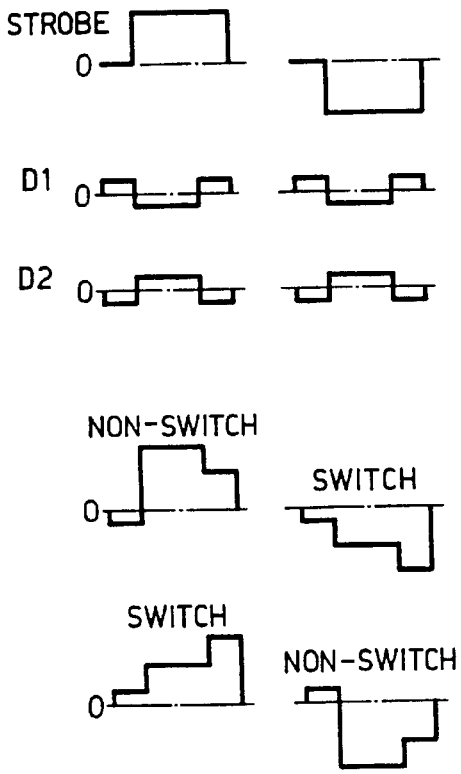
FIG. 22 shows strobe, data, and resultant waveforms for a known addressing scheme which uses a four time slot period for the waveforms.
Figure 23:
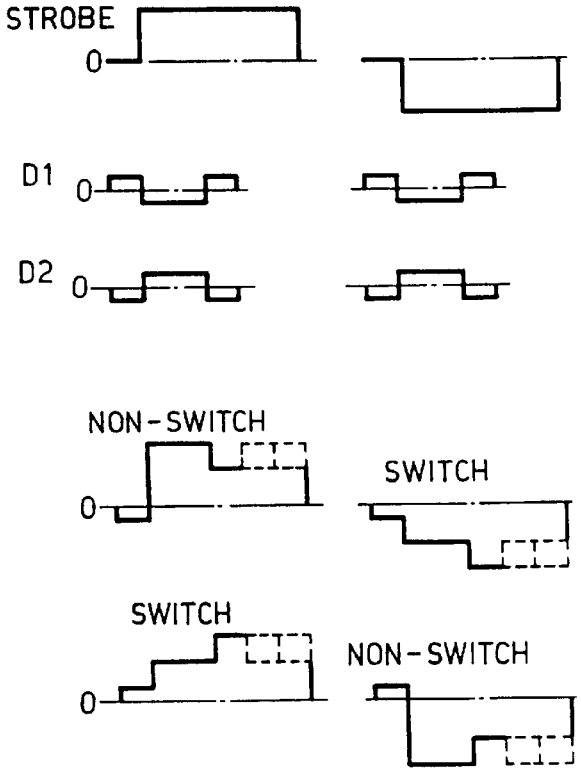
FIGS. 23, 24 show strobe and data waveforms of FIG. 22 modified by the present invention.
Figure 24:
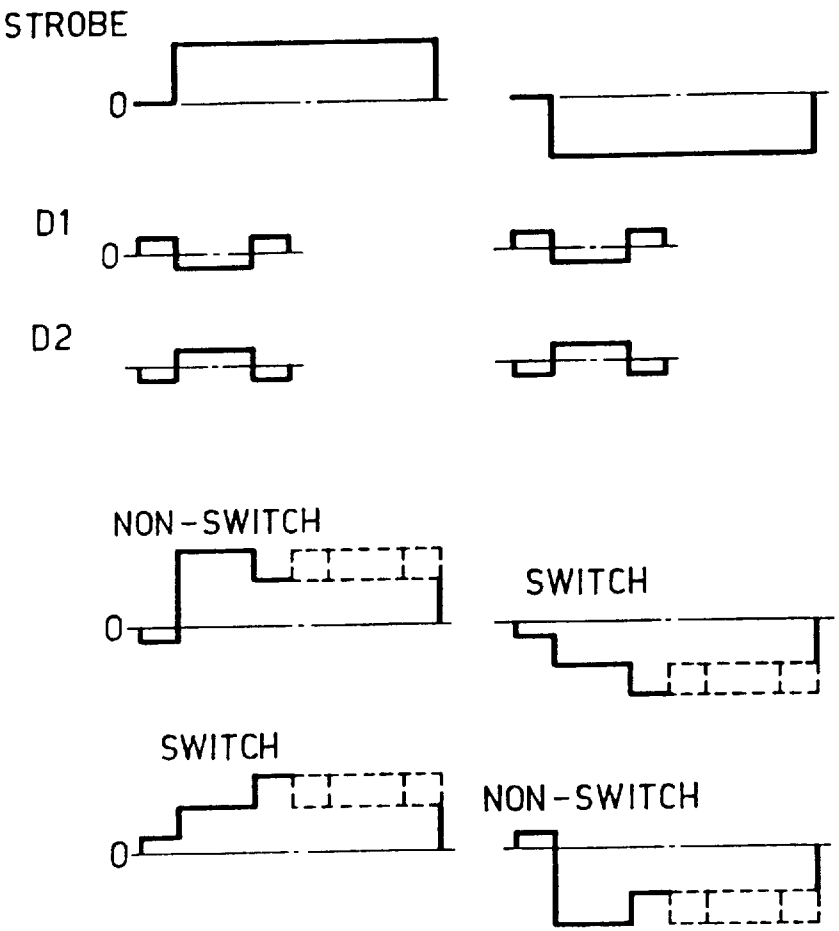

FIG. 22 shows a known addressing scheme, and FIGS. 23, 24 show how this can be modified by the present invention.

In FIG. 22 the strobe waveform is of four time slots (4 ts) long. In the first ts the voltage is zero, then Vs for 3 ts during a first field time. In the second field time the voltages are reversed. The data waveforms are: Data 1 +Vd for 1 ts, then −Vd for 2 ts, and +Vs for 1 ts; Data 2 is the inverse.

Resultant waveforms are shown. A non switch resultant of positive strobe and Data 1 is: −Vd, +Vs+Vd, +Vs+Vd, +Vs−Vd in successive time slots. A switching resultant of negative strobe and Data i is: −Vd, −(Vs−Vd), −(Vs−Vd), −(Vs+Vd) in successive time slots. Switching and non switching resultants are shown for Data 2, and are the inverse of the above.

FIG. 23 shows how the strobe of FIG. 22 may be ex tended by maintaining the voltage Vs for a further 2 ts. Successive rows are addressed after each data waveform period as in FIG. 22. This may result in different data 1 and data 2 waveforms being applied in any sequence to a particular column due to the required pattern of display. Resultant waveforms are shown and for the first 4 ts are as for FIG. 22. The dotted lines during the fifth and sixth time slots allow for the fact that the data waveforms at a particular pixel may change as the next row is being addressed.

FIG. 24 shows a strobe waveform extended by maintaining Vs for a further 4 ts. Resultant waveforms are shown far both switching and non switching waveforms. As with FIG. 23 dotted lines show possible variation of resultant due to the different pattern of data waveform which may be applied during addressing of the next row.

Figure 25:
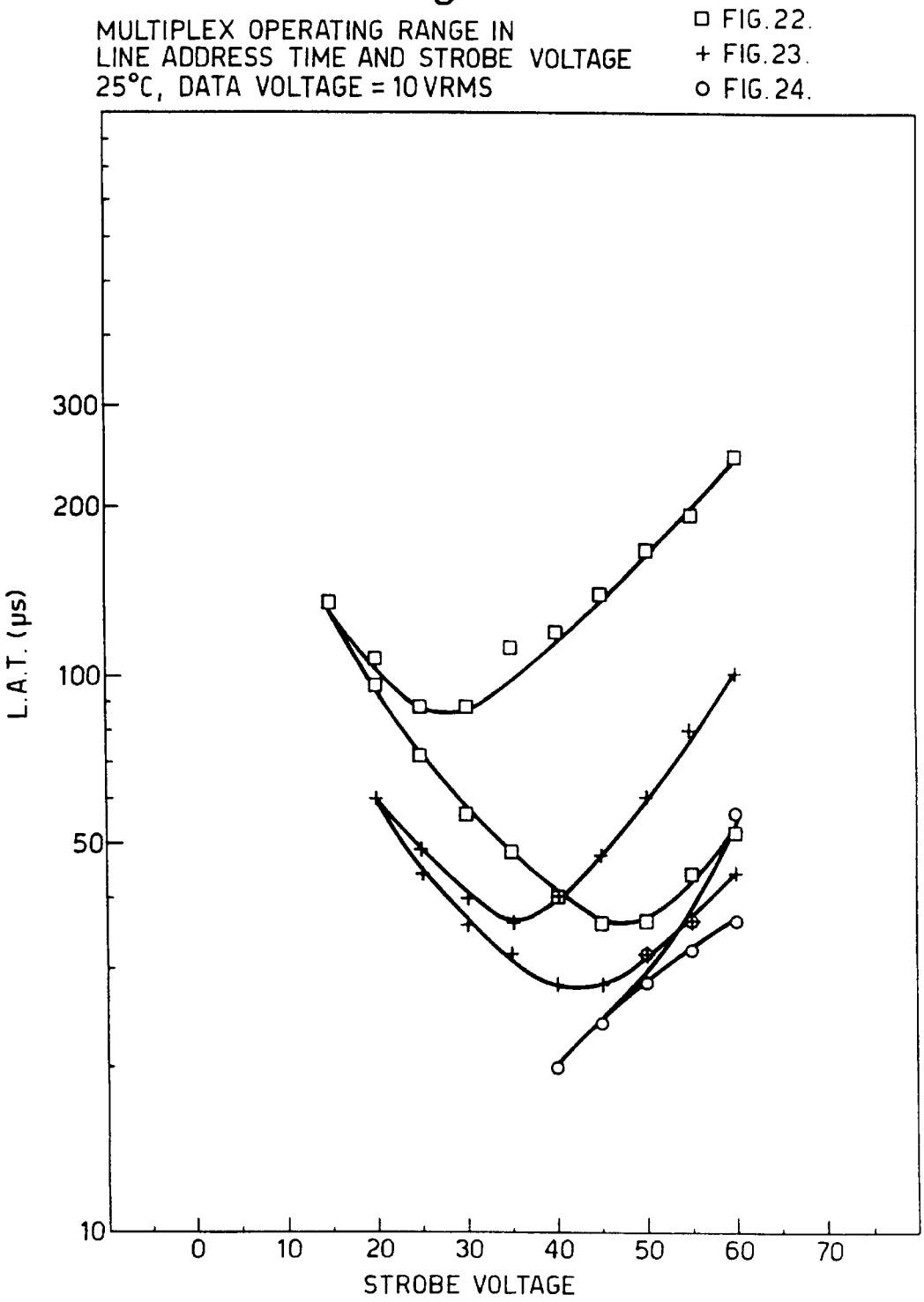
FIG. 25 shows switching characteristics for the addressing schemes of FIGS. 22–25.

The effect of the addressing schemes of FIGS. 22–24 on switching characteristics are shown in FIG. 25. The material used was Merck ZLI-5014-000, Vd=10 v, at a temperature of 25° C.

Figure 26:
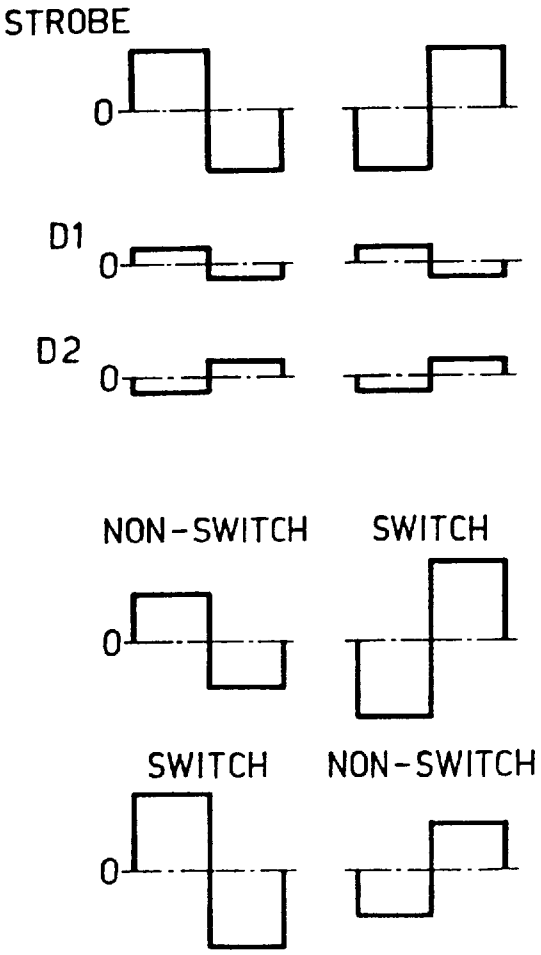
FIG. 26 shows strobe, data, and resultant waveforms for another known addressing scheme which uses bipolar pulses of opposite polarity, each pulse lasting one time slot.
Figure 28:
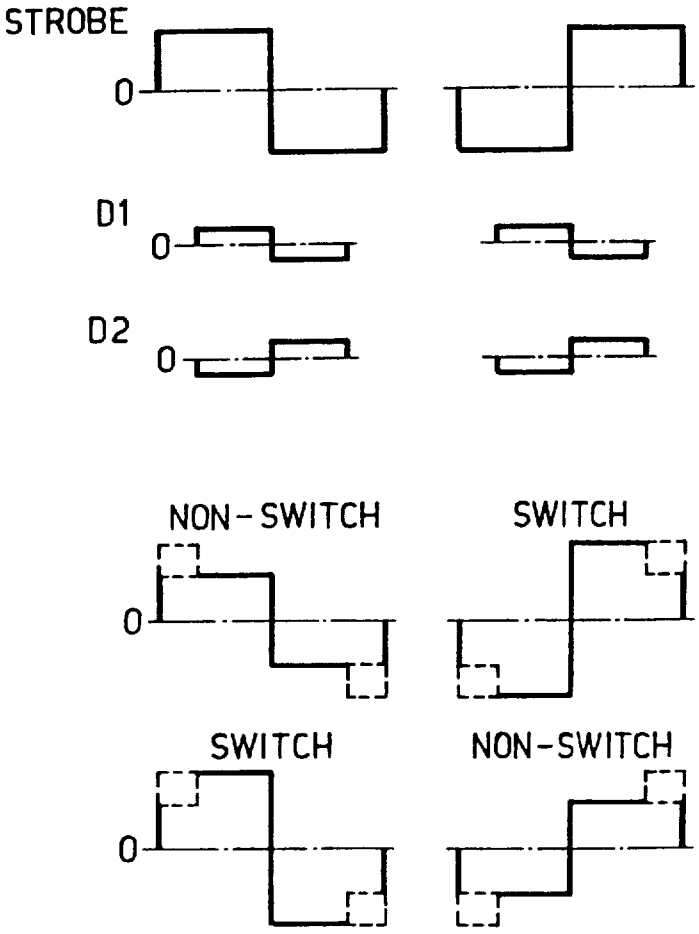
FIGS. 27, 28 shows strobe, data, and resultant waveforms of FIG. 26 modified by the present invention.
Figure 27:
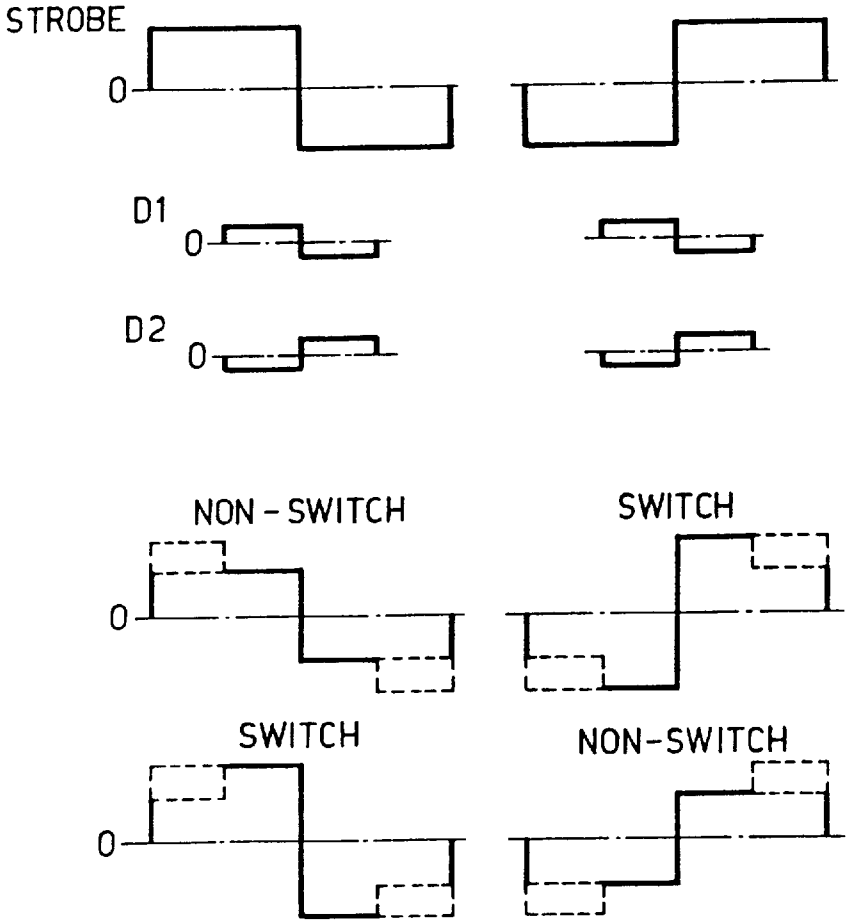

FIG. 26 shows another known addressing scheme, and FIGS. 27, 28 show how this can be modified by the present invention.

As shown in FIG. 26 a strobe waveform is a +Vs for 1 ts immediately followed by −Vs for 1 ts. This is used in a first field time, and its inverse used in a second field time. Data 1 waveform is +Vd for 1 ts and −Vd for the next 1 ts. Data 2 is the inverse of data 1. A non switching resultant waveform is Vs−Vd for its followed by −(Vs−Vd) for 1 ts. A switching resultant waveform is Vd+Vs for its followed by −(Vs+Vd) for its. Both non switching and switching is also shown by the inverse of the above.

FIG. 27 shows the strobe pulse of FIG. 26 extended in time. The first and second pulse are extended to occupy 2 ts. This requires that the first strobe pulse is applied before the relevant data waveform, ie the strobe is started its ahead of normal whilst a previous row is being addressed. The second strobe pulse extends after the relevant data waveform has ceased and the next row is being addressed. A pixel that does not switch receives +Vs+Vd or Vs−Vd, +Vs−Vd, −(Vs−Vd), −(Vs+Vd) or −(Vs−Vd) in successive time slots. The reason for alternatives, shown in dotted, is possible different data waveform applied during the previous and the next addressed row. A pixel that switches receives −(Vs+Vd) or −(Vs−Vd), −(Vs+Vd), +Vs+Vd, +Vs+Vd or +(Vs−Vd) in successive time slots. The inverse of these two resultants are also non switching or switching respectively.

FIG. 28 shows another modification of FIG. 26. In this the strobe is extended by 1.5 ts in both the positive and negative pulses. As shown the first pulse extends into the addressing of the previous row by 0.5 ts, whilst the second pulse extends 0.5 ts into the addressing time of the next row. A non switching resultant waveform is +Vd or −Vd for 0.5 ts, Vs+Vd or Vs−Vd for 0.5 ts, Vs−Vd for 1 ts, −(Vs−Vd) for 1 ts, −(Vs+Vd) or −(Vs−Vd) for 0.5 ts, +Vd or −Vd for 0.5 ts. A switching resultant waveform is +Vd or −Vd for 0.5 ts, −(Vs+vd) or −(Vs−Vd) for 0.5 ts, −(Vs+Vd) for its, +Vs+Vd for its, +Vs+Vd or +Vs−Vd for 0.5 ts, and +Vd or −Vd for 0.5 ts. The inverse of these two resultants also does not or does switch as illustrated.

Suitable liquid crystal materials are:

Merck catalogue reference number SCE 8 (available from Merck Ltd Poole, England) which has a Ps of about 5 nC/square cm at 30° C., a dielectric anisotropy of about −2.0, and a phase sequence of: Sc 59° C. Sa 79° C. N 98° C.

Mixture A which contains 5% racemic dopant and 3% chiral dopant in the host;

Mixture B which contains 9.5% racemic dopant and 3.5% chiral dopant in the host.

Host

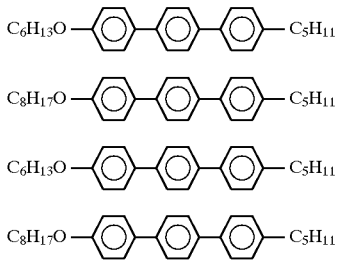

37% by weight

41%

14%

8

Dopant (both racemic and chiral)

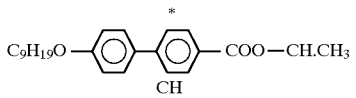

The * denotes chirality, without it the material is racemic.

Another suitable mixture is Merck catalogue reference number ZLI-5014-000 (available from Merck, Poole, England) which has a spontaneous polarisation coefficient (Ps) of −2.8 nC/cm$^2$ at 20° C., a dielectric anisotropy of −0.7, and phase sequence of −10° C. Sc 64° C. Sa 68° C. N 70° C. I.

Both mixtures A, B have a Ps of about 7 nC/square cm at 30° C. and a dielectric anisotropy of about −2.3.

Mixture A has the phase sequence Sc 100° C. Sa 111° C. N 136° C.

Mixture B has the phase sequence Sc 87° C. 118° C. N 132° C.

Device operating parameters and contrast ratios for some of the addressing schemes shown above are as follows:

Material SCE8 in a 1.8 $\mu$m thick layer at 25° C.

TABLE 3 addressing scheme of FIG. 11

| Vs | Vd | ts | CR |
|---|---|---|---|
| 50 | 5 | 36–53 | 8–7 |
| 50 | 7.5 | 46–115 | 45–15 |
| 40 | 10 | 46–88 | 77–21.5 |
| 50 | 10 | 57–140 | 71–9.5 |

TABLE 4 addressing scheme of FIG. 12

| | | | |
|---|---|---|---|
| 50 | 7.5 | 40–73 | 26–11 |
| 40 | 10 | 34–57 | 64–23 |
| 50 | 10 | 47–100 | 67–17 |

TABLE 5

| addressing scheme of FIG. 8 | | | |
|---|---|---|---|
| 50 | 5 | 65–450 | 23–3 |
| 50 | 7.5 | 75–480 | 65–2.2 |
| 40 | 10 | 95–345 | 49–2.7 |
| 50 | 10 | 83–370 | 63–2.3 |

Mixture B in a layer 1.7 $\mu$m thick at 30° C.

TABLE 6

| addressing scheme of FIG. 11 | | | |
|---|---|---|---|
| Vs | Vd | ts | CR (at lowest ts) |
| 50 | 10 | 22–78 | 51 |
| 50 | 7.5 | 17–82 | 33 |
| 40 | 10 | 16–47 | 56 |

TABLE 7

| addressing scheme of FIG. 12 | | | |
|---|---|---|---|
| 50 | 10 | 20–68 | 51 |
| 50 | 7.5 | 14–62 | 24 |
| 40 | 10 | 13–36 | 53 |
| 40 | 7.5 | 10–37 | 7.2 |
| 45 | 7.5 | 10–42 | 10 |

We claim:

1. A method of temperature compensating a multiplex addressed ferro electric liquid crystal matrix display comprising the steps of:

providing a liquid crystal cell (1) with cell walls (2, 3) enclosing a layer (7) of ferroelectric liquid crystal material;

providing a first set of electrodes (5) on one cell wall (2) and a second set of electrodes (6) on the other cell wall (3), the electrodes (5, 6) forming by their intersections a matrix of addressable elements;

addressing sequentially each electrode individually in the first set of electrodes (5), such addressing being either by application of a strobe waveform (12) of pulses of positive and negative values, or by application of a blanking pulse followed by a strobe pulse and arranged to maintain a net zero d.c. value, applying (13) one of two data waveforms to each electrode in the second set of electrodes (6) synchronised with the strobe waveform, both data waveforms comprising pulses of positive and negative values each pulse lasting a time period of one time slot (ts) with one data waveform the inverse of the other data waveform, the temperature (15) of the liquid crystal material (7), varying the time length of the strobe waveform (12, 16) in accordance with the measured liquid crystal temperature whilst maintaining the same time between application of strobe waveform to successively addressed electrodes in the second set of electrodes and maintaining the same time periods (ts) in the data waveforms, whereby temperature induced changes in the liquid crystal material (7) parameters are compensated.

2. The method of claim 1 wherein the strobe waveform is a zero voltage in a first ts time period, and a non zero voltage for a period equal to n.ts where n is a positive number above about 0.25 ts, followed by several periods ts of zero voltage representing one field period, followed by a similar waveform of reversed polarity.

3. The method of claim 1 wherein the strobe waveform has positive and negative pulses which extend in time into the addressing time of adjacent electrodes.

4. The method of claim 2 wherein n varies continuously or in steps.

5. The method of claim 2 wherein the strobe waveform has a non-zero value in the first ts period, such non-zero value being of variable amplitude and sign to provide additional temperature compensation.

6. The method of claim 3 wherein the strobe waveform is a pulse of one polarity immediately followed by a pulse of the same amplitude but opposite polarity, and the length of each pulses is n.ts where n is a positive number above 0.25 ts.

7. The method of claim 1 wherein the blanking pulse has sections of opposite polarity whose voltage time product (Vt) combines with voltage time product of the strobe pulse to provide a net zero dc value.

8. The method of claim 1 wherein the blanking pulse has a voltage-time product that combines with the voltage-time product of the strobe pulse to provide a net zero dc value.

9. The method of claim 1 wherein the polarity of strobe, blanking, and data waveforms are periodically reversed to provide a net zero dc value.

10. The method of claim 1 wherein the length of the time periods of both strobe and data waveforms is varied to provide a temperature compensation.

11. The method of claim 1 wherein the period of the data waveforms is 2 ts.

12. The method of claim 1 wherein the period of the data waveforms is 4 ts.

13. The method of claim 1 wherein the period of the data waveforms is m.ts where m is an integer greater than one.

14. A temperature compensated multiplex addressed liquid crystal display comprising:

a liquid crystal cell (1) formed by a layer of liquid crystal material (7) contained between two cell walls, (2, 3), the liquid crystal material (7) being a tilted chiral smectic material, the cell walls (2, 3) carrying electrodes (5, 6) formed as a first series of electrodes (5) on one wall (2) and a second series of electrodes (6) on the other cell walls (13), the electrodes (5, 6) being arranged to form collectively a matrix of addressable intersections, at least one of the cell walls (2, 3) being surface treated to provide surface alignment to liquid crystal molecules along a single direction;

means (12) for generating a strobe waveform comprising dc pulses of positive and negative values;

driver circuits (10) for applying the strobe waveform in sequence to each electrode (5) in the first set of electrodes;

means (13) for generating two sets of data waveforms of equal amplitude and frequency but opposite sign, each data waveform comprising dc pulses of positive and negative values lasting a time period of one time slot (ts);

driver circuits (11) for applying the data waveforms to the second set of electrodes;

and means (14) for controlling the order of data waveforms so that a desired display pattern is obtained and an overall net zero dc level;

means (15) for measuring the temperature of the liquid crystal material;

means (14, 16, IC1 to IC8) for varying the length of at least one pulse in the strobe waveform, relative to the period of the data waveforms without changing the data waveform time periods (ts), in accordance with the measured liquid crystal temperature to compensate for changes in liquid crystal material parameters with temperature.

15. A temperature compensated multiplex addressed liquid crystal display comprising:

a liquid crystal cell formed by a layer of liquid crystal material contained between two cell walls, the liquid crystal material being a tilted chiral smectic material, said cell walls carrying electrodes formed as a first series of electrodes on one of said cell walls and a second series of electrodes on the other of said cell walls, the electrodes being arranged to form collectively a matrix of addressable intersections, at least one of the cell walls being surface treated to provide surface alignment to liquid crystal molecules along a single direction;

strobe generator generating a strobe waveform comprising dc pulses of positive and negative values;

at least one row driver circuit applying the strobe waveform in sequence to each electrode in the first set of electrodes;

a data generator generating two sets of data waveforms of equal amplitude and frequency but opposite sign, each data waveform comprising dc pulses of positive and negative values lasting a time period of one time slot;

at least one column driver circuit applying the data waveforms to the second set of electrodes;

control logic unit controlling the order of data waveforms so that a desired display pattern is obtained and an overall net zero dc level;

a thermocouple measuring the temperature of the liquid crystal material;

said control logic unit, in combination with a proportioning element and said driver circuits, varying the length of at least one pulse in the strobe waveform, relative to the period of the data waveforms, without changing the data waveform time periods, in accordance with the measured liquid crystal temperature to compensate for changes in liquid crystal material parameters with temperature.

* * * * *